US012790069B2

(12) United States Patent
Nannetti

(10) Patent No.: US 12,790,069 B2
(45) Date of Patent: Nov. 10, 2026

(54) CARDBOARD TRAY FOR RECEIVING ARTICLES, SUCH AS BOTTLES, SYRINGES, VIALS, IN A HORIZONTAL CONFIGURATION AND A DIE-CUT BLANK FOR OBTAINING THE TRAY

(71) Applicant: Marchesini Group S.P.A., Pianoro (IT)

(72) Inventor: Simone Nannetti, Grizzana Morandi (IT)

(73) Assignee: Marchesini Group S.P.A., Pianoro (IT)

( * ) Notice: Subject to any disclaimer, the term of this patent is extended or adjusted under 35 U.S.C. 154(b) by 0 days.

(21) Appl. No.: 18/844,242

(22) PCT Filed: Mar. 22, 2023

(86) PCT No.: PCT/IB2023/052798
§ 371 (c)(1),
(2) Date: Sep. 5, 2024

(87) PCT Pub. No.: WO2023/180941
PCT Pub. Date: Sep. 28, 2023

(65) Prior Publication Data

US 2025/0171196 A1 May 29, 2025

(30) Foreign Application Priority Data

Mar. 24, 2022 (IT) ..... 102022000005798

(51) Int. Cl.
*B65D 5/50* (2006.01)
*B65D 81/02* (2006.01)
*B65D 85/42* (2006.01)

(52) U.S. Cl.
CPC ..... *B65D 5/504* (2013.01)

(58) Field of Classification Search
CPC ..... A47F 5/112; A47F 7/0028; A47F 7/283; A47G 21/14; A61J 1/16;
(Continued)

(56) References Cited

U.S. PATENT DOCUMENTS 4,181,220 A * 1/1980 Zicko ..... B65D 5/5035 206/443
6,269,961 B1 * 8/2001 Porcelli ..... A47F 5/112 211/73

FOREIGN PATENT DOCUMENTS

CH 273276 A * 1/1951 ..... B65D 5/504
CH 711693 A1 * 4/2017 ..... B65D 5/542
(Continued)

OTHER PUBLICATIONS

International Search Report and Written Opinion for related International Patent Application No. PCT/IB2023/052798, mailed on Jul. 4, 2023, 10 pages.

*Primary Examiner* — Anthony D Stashick
*Assistant Examiner* — Marcos Javier Rodriguez Molina
(74) *Attorney, Agent, or Firm* — Jacob M. Ward; Ward Law Office LLC

(57) ABSTRACT

The cardboard tray for receiving articles in a horizontal configuration is realised with a single cardboard sheet having a second part of sheet folded with respect to a first fold line arranged above the first part to define a first non-operating configuration having a flat shape. The second part of sheet is fixed by a first sector of a first portion to the underlying first part and comprises a second portion, separated from the first portion by means of a second fold line, and a third portion separated from the second portion by means of a third fold line. A first semi-part and a second semi-part are folded and arranged facing one another to define a second opened-out operating configuration. A first part of slot and a second part of slot define a seat for receiving an article in a horizontal configuration.

16 Claims, 11 Drawing Sheets

(58) Field of Classification Search

CPC ..... A61M 2005/3131; A61M 2209/06; A61M 5/002; A61M 5/008; A61M 5/3129; B65D 5/3635; B65D 5/42; B65D 5/48; B65D 5/48002; B65D 5/48008; B65D 5/4801; B65D 5/48018; B65D 5/4802; B65D 5/48034; B65D 5/504; B65D 71/72; B65D 81/025; B65D 85/42; B65D 1/0246; B65D 1/0292; B65D 1/16; B65D 1/22; B65D 1/225; B65D 1/243; B65D 1/26; B65D 1/265; B65D 1/30; B65D 1/34; B65D 1/36; B65D 1/40; B65D 1/42; B65D 1/46; B65D 1/48; B65D 11/02; B65D 11/04; B65D 11/06; B65D 11/08; B65D 11/12; B65D 11/18; B65D 11/1826; B65D 11/1833; B65D 11/184; B65D 11/1853; B65D 11/186; B65D 11/1873; B65D 11/20; B65D 11/22; B65D 13/04; B65D 15/00; B65D 15/22; B65D 17/4012; B65D 19/0002; B65D 19/0012; B65D 19/0016; B65D 19/0018; B65D 19/0026; B65D 19/0028; B65D 19/0036; B65D 19/004; B65D 19/0051; B65D 19/0073; B65D 19/0095; B65D 19/04; B65D 19/06; B65D 19/12; B65D 19/18; B65D 19/20; B65D 19/38; B65D 19/385; B65D 19/42; B65D 19/44; B65D 2075/361; B65D 2075/362; B65D 21/00; B65D 21/02; B65D 21/0201; B65D 21/0202; B65D 21/0206; B65D 21/0209; B65D 21/0212; B65D 21/0215; B65D 21/0217; B65D 21/0219; B65D 21/0223; B65D 21/0227; B65D 21/0228; B65D 21/0233; B65D 21/0238; B65D 21/046; B65D 21/062; B65D 21/066; B65D 21/083; B65D 21/086; B65D 2203/00; B65D 2203/02; B65D 2203/06; B65D 2203/10; B65D 2205/00; B65D 2205/02; B65D 2207/00; B65D 2213/02; B65D 2215/02; B65D 2215/04; B65D 2231/005; B65D 2231/02; B65D 2231/022; B65D 2251/0015; B65D 2251/0021; B65D 2251/0025; B65D 2251/0028; B65D 2251/009; B65D 2251/0093; B65D 2251/1025; B65D 2251/1033; B65D 23/00; B65D 23/0842; B65D 23/106; B65D 2301/10; B65D 2301/20; B65D 2303/00; B65D 2313/02; B65D 2313/04; B65D 2313/08; B65D 2313/10; B65D 2401/00; B65D 2401/05; B65D 2401/10; B65D 2401/15; B65D 25/00; B65D 25/005; B65D 25/02; B65D 25/04; B65D 25/06; B65D 25/08; B65D 25/10; B65D 25/107; B65D 25/108; B65D 25/14; B65D 25/16; B65D 25/18; B65D 25/20; B65D 25/205; B65D 25/22; B65D 25/24; B65D 25/28; B65D 25/2808; B65D 25/2832; B65D 25/2838; B65D 25/2841; B65D 25/2852; B65D 25/2855; B65D 25/287; B65D 25/2873; B65D 25/2888; B65D 25/2897; B65D 25/30; B65D 25/32; B65D 25/34; B65D 25/36; B65D 25/54; B65D 2501/24019; B65D 2501/2407; B65D 2501/24108; B65D 2501/24127; B65D 2501/24152; B65D 2501/24216; B65D 2501/24248; B65D 2501/24305; B65D 2501/24337; B65D 2501/2435; B65D 2501/24656; B65D 2501/24719; B65D 2501/24904; B65D 2517/0049; B65D 2519/00019; B65D 2519/00024; B65D 2519/00029; B65D 2519/00034; B65D 2519/00039; B65D 2519/00044; B65D 2519/00054; B65D 2519/00059; B65D 2519/00064; B65D 2519/00069; B65D 2519/00074; B65D 2519/00079; B65D 2519/00089; B65D 2519/00094; B65D 2519/00099; B65D 2519/00104; B65D 2519/00124; B65D 2519/00129; B65D 2519/00134; B65D 2519/00139; B65D 2519/00159; B65D 2519/00164; B65D 2519/00169; B65D 2519/00174; B65D 2519/00184; B65D 2519/00194; B65D 2519/00199; B65D 2519/00208; B65D 2519/00228; B65D 2519/00233; B65D 2519/00243; B65D 2519/00268; B65D 2519/00273; B65D 2519/00278; B65D 2519/00288; B65D 2519/00293; B65D 2519/00298; B65D 2519/00303; B65D 2519/00308; B65D 2519/00318; B65D 2519/00323; B65D 2519/00333; B65D 2519/00338; B65D 2519/00343; B65D 2519/00348; B65D 2519/00358; B65D 2519/00373; B65D 2519/00378; B65D 2519/00402; B65D 2519/00407; B65D 2519/00412; B65D 2519/00422; B65D 2519/00432; B65D 2519/00437; B65D 2519/00442; B65D 2519/00452; B65D 2519/00497; B65D 2519/00502; B65D 2519/00512; B65D 2519/00517; B65D 2519/00532; B65D 2519/00557; B65D 2519/00562; B65D 2519/00567; B65D 2519/00572; B65D 2519/00582; B65D 2519/00587; B65D 2519/00597; B65D 2519/00601; B65D 2519/00606; B65D 2519/00611; B65D 2519/00621; B65D 2519/00626; B65D 2519/00631; B65D 2519/00641; B65D 2519/00646; B65D 2519/00651; B65D 2519/00656; B65D 2519/00661; B65D 2519/00666; B65D 2019/00691; B65D 2519/00696; B65D 2519/00701; B65D 2519/00711; B65D 2519/00731; B65D 2519/00746; B65D 2519/00751; B65D 2519/00771; B65D 2519/00781; B65D 2519/00786; B65D 2519/00791; B65D 2519/00796; B65D 2519/008; B65D 2519/00805; B65D 2519/0081; B65D 2519/00815; B65D 2519/0082; B65D 2519/00835; B65D 2519/0086; B65D 2519/0087; B65D 2519/00875; B65D 2519/009; B65D 2519/0091; B65D 2519/00915; B65D 2519/00925; B65D 2519/0093; B65D 2519/00935; B65D 2519/0094; B65D 2519/0096; B65D 2519/00965; B65D 2519/0097; B65D 2519/00975; B65D 2519/0098; B65D 2519/0099; B65D 2519/00995; B65D 2525/285; B65D 2525/288; B65D 2543/00046; B65D 2543/00092; B65D 2543/00194; B65D 2543/0025; B65D

2543/00268; B65D 2543/00296; B65D 2543/00351; B65D 2543/00425; B65D 2543/0049; B65D 2543/005; B65D 2543/00509; B65D 2543/00518; B65D 2543/00527; B65D 2543/00537; B65D 2543/00546; B65D 2543/00555; B65D 2543/00564; B65D 2543/0062; B65D 2543/00629; B65D 2543/00638; B65D 2543/00685; B65D 2543/00731; B65D 2543/0074; B65D 2543/00796; B65D 2543/00842; B65D 2543/00972; B65D 2565/385; B65D 2571/00018; B65D 2571/00037; B65D 2571/00043; B65D 2571/00055; B65D 2571/100061; B65D 2571/00067; B65D 2571/00074; B65D 2571/00111; B65D 2571/00117; B65D 2571/00141; B65D 2471/00154; B65D 2571/0016; B65D 2571/00172; B65D 2571/00185; B65D 2571/00222; B65D 2571/00265; B65D 2571/00271; B65D 2571/00277; B65D 2571/00283; B65D 2571/0029; B65D 2571/00296; B65D 2571/00302; B65D 2571/00308; B65D 2571/00314; B65D 2571/0032; B65D 2571/00339; B65D 2571/00351; B65D 2571/0037; B65D 2571/00382; B65D 2571/00388; B65D 2571/00401; B65D 2571/00419; B65D 2571/00444; B65D 2571/0045; B65D 2571/00465; B65D 2571/00469; B65D 2571/00475; B65D 2571/00481; B65D 2571/00487; B65D 2571/00512; B65D 2571/00524; B65D 2571/00543; B65D 2571/00549; B65D 2571/00555; B65D 2571/00567; B65D 2571/00574; B65D 2571/0058; B65D 2571/00586; B65D 2571/00617; B65D 2571/0066; B65D 2571/00666; B65D 2571/00703; B65D 2571/00716; B65D 2571/00728; B65D 2571/00753; B65D 2571/00759; B65D 2571/00783; B65D 2571/0079; B65D 2571/00796; B65D 2571/00802; B65D 2571/00808; B65D 2571/00814; B65D 2571/00839; B65D 2571/00858; B65D 2571/00864; B65D 2571/0087; B65D 2571/00895; B65D 2571/00919; B65D 2571/00925; B65D 2571/00932; B65D 2571/00956; B65D 2571/00975; B65D 2571/00981; B65D 2571/00987; B65D 2575/363; B65D 2575/368; B65D 2577/043; B65D 2577/045; B65D 2577/2025; B65D 2577/205; B65D 2577/2091; B65D 2581/053; B65D 2581/055; B65D 2581/058; B65D 2581/3406; B65D 2581/3413; B65D 2581/3421; B65D 2581/344; B65D 2581/3447; B65D 2581/3452; B65D 2581/3456; B65D 2581/346; B65D 2581/3462; B65D 2581/3466; B65D 2581/3471; B65D 2581/3472; B65D 2581/3474; B65D 2581/3477; B65D 2581/3478; B65D 2581/3479; B65D 2581/3481; B65D 2581/3483; B65D 2581/3489; B65D 2581/3493; B65D 2581/3494; B65D 2581/3495; B65D 2581/3497; B65D 2581/3498; B65D 2583/005; B65D 2585/363; B65D 2585/366; B65D 2585/647; B65D 2585/648; B65D 2585/6837; B65D 2585/6855; B65D 2585/6862; B65D 2585/6867; B65D 2585/6882; B65D 2585/6885; B65D 2585/88; B65D 2590/046; B65D 27/00; B65D 27/06; B65D 27/08; B65D 27/10; B65D 27/34; B65D 3/06; B65D 3/20; B65D 3/24; B65D 31/02; B65D 31/06; B65D 31/10; B65D 31/12; B65D 31/16; B65D 33/001; B65D 33/007; B65D 33/008; B65D 33/01; B65D 33/02; B65D 33/06; B65D 33/08; B65D 33/12; B65D 33/14; B65D 33/16; B65D 33/1691; B65D 33/22; B65D 33/24; B65D 33/25; B65D 33/2508; B65D 33/2541; B65D 33/28; B65D 35/08; B65D 37/00; B65D 41/04; B65D 41/3428; B65D 43/00; B65D 43/02; B65D 43/0202; B65D 43/0204; B65D 43/021; B65D 43/0212; B65D 43/0214; B65D 43/022; B65D 43/0222; B65D 43/0231; B65D 43/0274; B65D 43/12; B65D 43/16; B65D 43/162; B65D 43/163; B65D 43/164; B65D 43/169; B65D 43/20; B65D 43/22; B65D 43/24; B65D 45/00; B65D 45/20; B65D 47/06; B65D 47/063; B65D 47/065; B65D 47/066; B65D 47/0838; B65D 47/2031; B65D 47/286; B65D 5/00; B65D 5/0005; B65D 5/001; B65D 5/0015; B65D 5/002; B65D 5/0025; B65D 5/003; B65D 5/0035; B65D 5/004; B65D 5/0045; B65D 5/005; B65D 5/0055; B65D 5/006; B65D 5/0075; B65D 5/008; B65D 5/0085; B65D 5/009; B65D 5/0095; B65D 5/02; B65D 5/0209; B65D 5/0227; B65D 5/0236; B65D 5/0245; B65D 5/0254; B65D 5/0263; B65D 5/0281; B65D 5/029; B65D 5/04; B65D 5/06; B65D 5/061; B65D 5/067; B65D 5/08; B65D 5/10; B65D 5/103; B65D 5/106; B65D 5/12; B65D 5/16; B65D 5/18; B65D 5/20; B65D 5/2004; B65D 5/2009; B65D 5/2019; B65D 5/2023; B65D 5/2028; B65D 5/2033; B65D 5/2038; B65D 5/2042; B65D 5/2047; B65D 5/2052; B65D 5/2057; B65D 5/2076; B65D 5/2085; B65D 5/209; B65D 5/22; B65D 5/241; B65D 5/244; B65D 5/246; B65D 5/247; B65D 5/248; B65D 5/26; B65D 5/28; B65D 5/302; B65D 5/305; B65D 5/308; B65D 5/32; B65D 5/321; B65D 5/322; B65D 5/323; B65D 5/324; B65D 5/326; B65D 5/327; B65D 5/36; B65D 5/3614; B65D 5/3621; B65D 5/3628; B65D 5/3642; B65D 5/365; B65D 5/3678; B65D 5/38; B65D 5/40; B65D 5/4204; B65D 5/4208; B65D 5/4212; B65D 5/4216; B65D 5/422; B65D 5/4225; B65D 5/4233; B65D 5/4245; B65D 5/425; B65D 5/4266; B65D 5/427; B65D 5/4279; B65D 5/4295; B65D 5/441; B65D 5/443; B65D 5/445; B65D 5/446; B65D 5/46;

B65D 5/46024; B65D 5/46072; B65D 5/4608; B65D 5/46088; B65D 5/46096; B65D 5/46112; B65D 5/4612; B65D 5/46192; B65D 5/48004; B65D 5/48014; B65D 5/48022; B65D 5/48024; B65D 5/48026; B65D 5/48038; B65D 5/4804; B65D 5/48042; B65D 5/48046; B65D 5/48048; B65D 5/50; B65D 5/5004; B65D 5/5007; B65D 5/5009; B65D 5/5011; B65D 5/5014; B65D 5/5016; B65D 5/5019; B65D 5/5021; B65D 5/5023; B65D 5/5028; B65D 5/503; B65D 5/5035; B65D 5/5038; B65D 5/5054; B65D 5/5059; B65D 5/5061; B65D 5/5064; B65D 5/5069; B65D 5/5076; B65D 5/509; B65D 5/52; B65D 5/5206; B65D 5/5213; B65D 5/5226; B65D 5/5233; B65D 5/5246; B65D 5/5253; B65D 5/526; B65D 5/528; B65D 5/5286; B65D 5/54; B65D 5/5405; B65D 5/541; B65D 5/5415; B65D 5/542; B65D 5/5425; B65D 5/5435; B65D 5/5445; B65D 5/545; B65D 5/5455; B65D 5/546; B65D 5/5475; B65D 5/548; B65D 5/5495; B65D 5/56; B65D 5/563; B65D 5/566; B65D 5/60; B65D 5/606; B65D 5/62; B65D 5/64; B65D 5/66; B65D 5/6602; B65D 5/6608; B65D 5/6626; B65D 5/6629; B65D 5/6632; B65D 5/6638; B65D 5/6641; B65D 5/6644; B65D 5/6647; B65D 5/665; B65D 5/6652; B65D 5/6655; B65D 5/6658; B65D 5/6661; B65D 5/6664; B65D 5/6667; B65D 5/667; B65D 5/6685; B65D 5/6697; B65D 5/68; B65D 5/685; B65D 5/701; B65D 5/72; B65D 5/721; B65D 5/722; B65D 5/724; B65D 5/725; B65D 5/726; B65D 5/728; B65D 5/746; B65D 50/046; B65D 51/18; B65D 51/20; B65D 51/222; B65D 51/247; B65D 51/28; B65D 51/2814; B65D 51/2835; B65D 51/2842; B65D 51/2864; B65D 53/02; B65D 53/06; B65D 55/024; B65D 55/16; B65D 61/00; B65D 65/02; B65D 65/14; B65D 65/38; B65D 65/403; B65D 65/406; B65D 65/42; B65D 65/46; B65D 65/466; B65D 69/00; B65D 7/14; B65D 7/20; B65D 7/26; B65D 7/44; B65D 71/00; B65D 71/0003; B65D 71/0014; B65D 71/0022; B65D 71/0029; B65D 71/004; B65D 71/0048; B65D 71/0074; B65D 71/0077; B65D 71/0088; B65D 71/0096; B65D 71/02; B65D 71/04; B65D 71/10; B65D 71/125; B65D 71/14; B65D 71/16; B65D 71/20; B65D 71/28; B65D 71/30; B65D 71/34; B65D 71/36; B65D 71/38; B65D 71/40; B65D 71/42; B65D 71/44; B65D 71/46; B65D 71/48; B65D 71/50; B65D 71/70; B65D 73/0021; B65D 73/0064; B65D 73/0078; B65D 73/0085; B65D 75/002; B65D 75/004; B65D 75/006; B65D 75/008; B65D 75/02; B65D 75/12; B65D 75/14; B65D 75/20; B65D 75/225; B65D 75/24; B65D 75/245; B65D 75/26; B65D 75/305; B65D 75/323; B65D 75/324; B65D 75/327; B65D 75/36; B65D 75/366; B65D 75/367; B65D 75/368; B65D 75/38; B65D 75/52; B65D 75/54; B65D 75/566; B65D 75/5838; B65D 75/585; B65D 75/5855; B65D 75/5877; B65D 75/5883; B65D 75/5888; B65D 77/003; B65D 77/006; B65D 77/02; B65D 77/04; B65D 77/0413; B65D 77/042; B65D 77/0426; B65D 77/0433; B65D 77/046; B65D 77/0466; B65D 77/06; B65D 77/061; B65D 77/062; B65D 77/065; B65D 77/067; B65D 77/20; B65D 77/2008; B65D 77/2016; B65D 77/2024; B65D 77/2032; B65D 77/2056; B65D 77/208; B65D 77/2088; B65D 77/22; B65D 77/245; B65D 77/26; B65D 77/28; B65D 77/30; B65D 77/32; B65D 77/38; B65D 79/02; B65D 81/02; B65D 81/022; B65D 81/03; B65D 81/05; B65D 81/051; B65D 81/052; B65D 81/054; B65D 81/055; B65D 81/056; B65D 81/057; B65D 81/058; B65D 81/07; B65D 81/075; B65D 81/107; B65D 81/1075; B65D 81/127; B65D 81/1275; B65D 81/133; B65D 81/18; B65D 81/20; B65D 81/2038; B65D 81/2076; B65D 81/24; B65D 81/261; B65D 81/262; B65D 81/263; B65D 81/264; B65D 81/265; B65D 81/267; B65D 81/268; B65D 81/28; B65D 81/32; B65D 81/3205; B65D 81/3216; B65D 81/3283; B65D 81/34; B65D 81/343; B65D 81/3446; B65D 81/3453; B65D 81/3461; B65D 81/3469; B65D 81/3476; B65D 81/36; B65D 81/361; B65D 81/365; B65D 81/368; B65D 81/38; B65D 81/3806; B65D 81/3811; B65D 81/3813; B65D 81/3816; B65D 81/3818; B65D 81/3823; B65D 81/3853; B65D 81/3858; B65D 81/386; B65D 81/3869; B65D 81/3874; B65D 81/3876; B65D 81/3888; B65D 81/3893; B65D 81/3897; B65D 83/02; B65D 83/04; B65D 83/0463; B65D 83/0472; B65D 83/06; B65D 83/08; B65D 83/0805; B65D 83/0847; B65D 83/0858; B65D 83/0876; B65D 83/0894; B65D 83/141; B65D 83/164; B65D 83/182; B65D 83/184; B65D 83/22; B65D 83/24; B65D 83/303; B65D 83/38; B65D 83/384; B65D 83/682; B65D 83/756; B65D 83/771; B65D 85/00; B65D 85/04; B65D 85/07; B65D 85/1045; B65D 85/18; B65D 85/182; B65D 85/185; B65D 85/20; B65D 85/32; B65D 85/324; B65D 85/34; B65D 85/345; B65D 85/36; B65D 85/38; B65D 85/46; B65D 85/48; B65D 85/505; B65D 85/52; B65D 85/546; B65D 85/548; B65D 85/60; B65D 85/62; B65D 85/671; B65D 85/68; B65D 85/70; B65D 85/72; B65D 85/804; B65D 85/8046; B65D 85/808; B65D 85/812; B65D 88/005; B65D 88/022; B65D 88/12; B65D 88/121; B65D 88/129; B65D

88/14; B65D 88/30; B65D 88/52; B65D 88/522; B65D 88/524; B65D 88/528; B65D 88/54; B65D 88/60; B65D 88/68; B65D 88/74; B65D 90/0026; B65D 90/0033; B65D 90/0053; B65D 90/006; B65D 80/0066; B65D 90/008; B65D 90/046; B65D 90/08; B65D 90/205

USPC ..... 206/562

See application file for complete search history.

(56) References Cited

FOREIGN PATENT DOCUMENTS

| | | | | | |
|---|---|---|---|---|---|
| DE | 2356130 | A1 | | 5/1974 | |
| DE | 9115563 | | | 4/1993 | |
| DE | 20101737 | U1 | * | 4/2001 | ..... B65D 5/5021 |
| DE | 202014005810 | U1 | * | 8/2014 | ..... B65D 5/504 |
| EP | 1605307 | A1 | * | 12/2005 | ..... B41J 11/0015 |
| EP | 3702293 | A1 | * | 9/2020 | ..... B65D 5/504 |
| EP | 3828093 | A1 | | 6/2021 | |
| FR | 2198466 | A | * | 3/1974 | ..... B65D 5/504 |
| FR | 2198466 | A5 | * | 3/1974 | ..... B65D 5/504 |
| FR | 2632937 | A1 | * | 12/1989 | ..... B65D 85/42 |

* cited by examiner

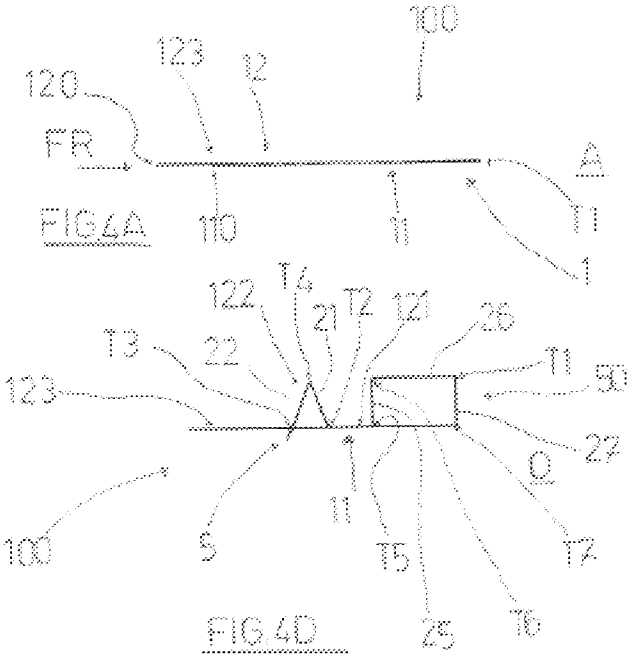
100
A
11
1
12
123
120
FR
10
FIG 4A
50
22
12
16
25
26
121
T5
T2
21
T4
122
22
T3
123
5
100
FIG 4D
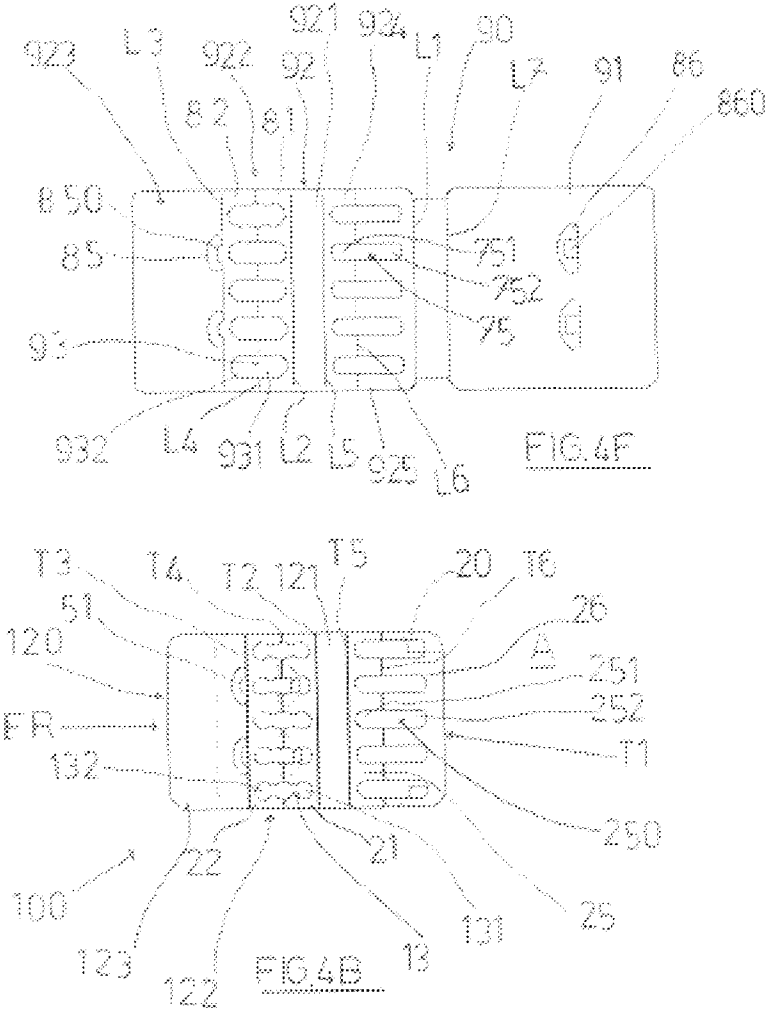
860
86
91
90
L7
L1
924
921
92
922
81
L3
923
850
85
93
932
L4
931
L2
L5
925
L6
751
752
75
FIG 4F
20
16
26
251
252
T1
250
25
101
13
21
T5
121
T2
T4
14
T3
51
120
FR
132
22
100
123
122
FIG 4B 100
110
120
123
12
11
A
T1
T2
T3
T4
T5
T6
T7
16
26
27
21
22
25
121
122
131
132
13
20
260
51
FR
86
800
91
L3
90
76
921
L1
L6
L5
92
L2
81
L4
82
925
924
931
922
923
850
85
93

CARDBOARD TRAY FOR RECEIVING ARTICLES, SUCH AS BOTTLES, SYRINGES, VIALS, IN A HORIZONTAL CONFIGURATION AND A DIE-CUT BLANK FOR OBTAINING THE TRAY

DESCRIPTION OF THE INVENTION

Field of the Invention

The present invention relates to the technical sector concerning packaging of articles having an elongate shape, i.e. having a prevalent longitudinal extension, such as, for example bottles, syringes, vials, etc., containing pharmaceutical, parapharmaceutical or cosmetic products.

Description of the Prior Art

In this specific technical sector, a procedure that is usually performed to carry out the packaging of this type of article includes positioning the articles in a relative support tray and, successively, inserting the tray with the articles supported internally of a relative box to obtain the final package.

A known packaging method comprises positioning and arranging the articles, such as, for example bottles, syringes, vials, and other like articles having an elongate shape, in a prevalent longitudinal extension, containing pharmaceutical, parapharmaceutical or cosmetic products, in a support tray in such a way that the articles can be positioned, and kept, in a horizontal configuration.

The trays used to receive the articles in the horizontal configuration must include a sort of seat or "housing" which enables inserting the articles in the seat or housing in such a way that the articles are arranged in a horizontal configuration and are kept stable in this position, to enable the trays to be inserted internally of relative boxes.

Trays can be made of a plastic or cardboard material.

For various reasons, in recent times the use of trays made of cardboard has been progressively increasing.

A known cardboard tray (V), for receiving articles having an elongate shape, such as bottles, syringes, vials, in a horizontal configuration, then to be inserted in a relative box, is illustrated in FIG. 1A.

The tray (V) comprises at least a cardboard sheet (F), for example having a rectangular shape, constituting a rest base for the tray (V) and comprising at least a through-window (F1), made transversally in an internal portion of the sheet (F), and at least a support element (S) made of cardboard comprising two main portions (S1, S2) folded with one another along a fold line (P) in such a way as to be substantially facing one another and to form a sort of overturned "V" shape.

The support element (S) made of cardboard is inserted with the two main portions (S1, S2) folded with one another in a "V" shape in the through-window (F1) so that the two main portions (S1, S2) are projecting vertically above the cardboard sheet (F).

The support element (S) also comprises two auxiliary portions (S3, S4), respectively hinged by respective fold lines (P1, P2) to the two main portions (S1, S2), and folded with respect to the two main portions (S1, S2) in such a way as to abut the lower surface of the cardboard sheet (F): the two auxiliary portions (S3, S4) are fixed, for example by gluing, to the lower surface of the cardboard sheet (F) (see for example FIG. 1B).

The support element (S) also comprises, at the facing sides of the two main portions (S1, S2), folded in a "V"-shape, and projecting superiorly and vertically from the cardboard sheet, respective through-slots (A1, A2) which are facing one another.

The through-slots (A1, A2), made at the facing sides of the folded two main portions (S1, S2) of the support element (S), define a seat (V), or housing, for the positioning of a respective article in a horizontal configuration with respect to the cardboard sheet.

In substance, the through-slots (A1, A2) are made in such a way as to form a seat (V), or housing, having a substantially complementary shape to a lateral portion of the lateral surface of the article (bottle, syringe, vial) which is to be positioned in the tray (V) in a horizontal configuration.

The tray can also comprise a second support element, identical to the one described above, and each support element can be made in such a way as to comprise also a second seat or housing for a second article.

The number of support elements, and the number of seats or housings in each support element, can vary according to the type and quantity of articles to be packed internally of a same box.

A tray (V) of this type is made starting from a first die-cut blank (B1) made of cardboard having a rectangular shape and by a second die-cut blank (B2), also having a rectangular shape and smaller dimensions (see FIG. 1C).

The first die-cut blank (B1) will constitute the cardboard sheet (F), that is, the rest base of the tray (V), while the second die-cut blank (B2) gives rise to the support element (S) of the tray (V).

At least a transversal through-cut (T) is made in the first die-cut blank (B1), which will constitute the at least a through-window (F1) of the tray.

The following are made in the second die-cut blank (B2): a first transversal fold line (c1), substantially in a central area of the second die-cut blank (B2), a second (c2) and a third (c3) transversal fold line, on opposite sides of the first fold line (c1), parallel to one another and parallel to the first transversal fold line, in positions such as to define two main central parts (D1, D2), separated from one another by the first transversal fold line (c1), and two external auxiliary parts (D3, D4), hinged respectively to the two main parts (D1, D3) by means of respectively the second (c2) and the third (c3) transversal fold line.

At least a through-opening (E) is made in the second die-cut blank (B2) astride the first transversal fold line (c1) in such a way that the through-opening (E1) has a first through-portion (E1) into a first part (D1) of the second die-cut blank (B2) and a second though-portion (E2) in the second main part (D2) of the second die-cut blank (B2).

The through-opening (E) will go to form the seat (V) or housing of the tray.

In this way, the second die-cut blank (B2) can be folded about the first transversal fold line (c1) in such a way as to fold the two main parts (D1, D2) to one another, by arranging them substantially facing and then inserting the two main parts (D1, D2) of the second die-cut blank (B2) thus-folded into the through-cut (T) of the first die-cut blank (B1) (see FIG. 1B), and thus forming the support element (S) of the tray.

The two auxiliary parts (D3, D4) of the second die-cut blank (B2) are folded about the second (c2) and third (c3) transversal fold line so as to be arranged at an angle with respect to the two main parts (D1, D2) in such a way as to be fixed, for example by gluing, to the lower surface of the first die-cut blank (B1).

In this way, it is possible to obtain the cardboard tray (V) previously described and illustrated in FIG. 1A.

This type of tray, already pre-formed, i.e. opened-out in such a way as to have the seat, or housing, already defined, for positioning an article in a horizontal configuration, leads to some drawbacks.

Primarily, it has a support element which remains projecting superiorly of the sheet which constitutes the rest base of the tray.

Therefore, the volume of each single tray is not negligible.

The presence of the support elements projecting superiorly can represent an issue in the management of the collecting and movement operations of the tray, during the preliminary steps leading to the packaging operations.

The vertical volume of each single tray can also have negative repercussions on the dimensions of the stores in which the trays are to be stored, stacked on one another, then to be collected for the packaging operations of the articles (bottles, syringes, vials, etc.); the stores will therefore be of significant dimensions.

Further, with the aim of predisposing the trays internally of a relative store, the trays must be stacked on one another, with the projecting support elements of a tray which must be inserted for the purpose in the hollow part of the support elements of a relative upper tray.

This can lead to difficulties during the step of extraction of each single tray, and it is possible that more than one tray will be extracted in place of a single tray at a time, as the trays can get joined to one another at the position of the respective projecting support elements.

SUMMARY OF THE INVENTION

The aim of the present invention is therefore to provide a novel cardboard tray, for receiving articles, such as bottles, syringes, vials, and the like, in a horizontal configuration, which is able to obviate the drawbacks present in the prior art.

In particular, the aim of the present invention is therefore to provide a cardboard tray which can assume a flat initial configuration, for facilitating the operations of storing, collecting and moving internally of the packaging machine, and which can be brought, once extracted from a relative store, into an opened-out configuration so as to receive and keep articles in a horizontal configuration.

A further aim of the invention is to describe a novel cardboard die-cut blank which enables obtaining, once folded, the cardboard tray.

The above-mentioned advantages are obtained according to the contents of the claims.

BRIEF DESCRIPTION OF THE DRAWINGS

The characteristics of the invention will become obvious from the following description of preferred, but not exclusive, embodiments of a cardboard tray for receiving articles in an elongate shape, in a prevalent longitudinal extension, such as bottles, syringes, vials, in a horizontal configuration and of a die-cut blank from which the tray is obtained, carried out with reference to the accompanying tables of drawings, in which:

FIG. 3F is a plan view from above of the cardboard die-cut blank from which it is possible to obtain the cardboard tray of figures from 3A to 3E;

FIG. 4A illustrates, in a schematic lateral view, the cardboard tray of the invention in a flat initial configuration, and in a third possible preferred embodiment;

FIG. 4B is a plan view from above of the cardboard tray of FIG. 4A;

FIG. 4D is again a schematic lateral view of the cardboard tray of FIG. 4A in a final opened-out configuration;

FIG. 4F is a plan view from above of the cardboard tray of the cardboard die-cut blank from which it is possible to obtain the cardboard tray of figures from 4A to 4E

FIG. 6D is a schematic lateral view of the cardboard tray of FIG. 6A in a final opened-out configuration;

DESCRIPTION OF THE PREFERRED EMBODIMENTS

Figure 1C:
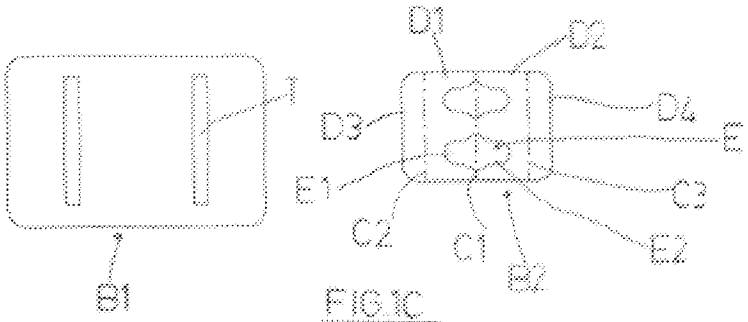
FIG. 1C is a plan view from above of the cardboard die-cut blanks from which it is possible to obtain the preformed tray of FIG. 1A.
Figure 1B:
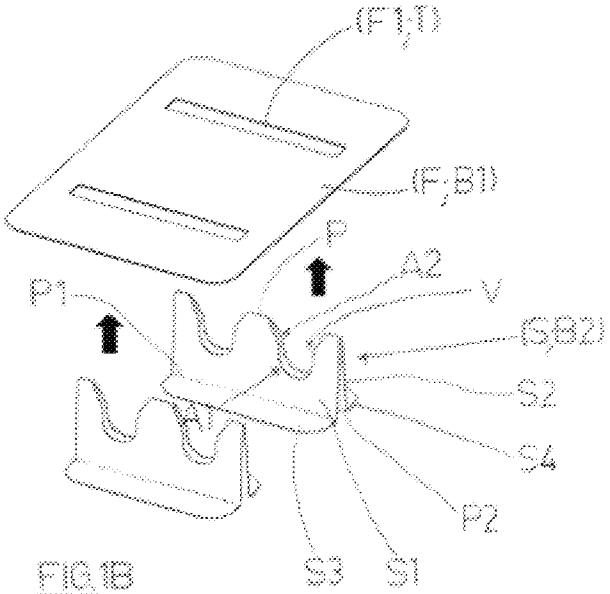
FIG 1B PRIOR ART
FIG. 1B, also mentioned in the foregoing, illustrates, in a perspective view, and in an exploded view, the components used for realising the preformed cardboard tray of FIG. 1A.
Figure 1A:
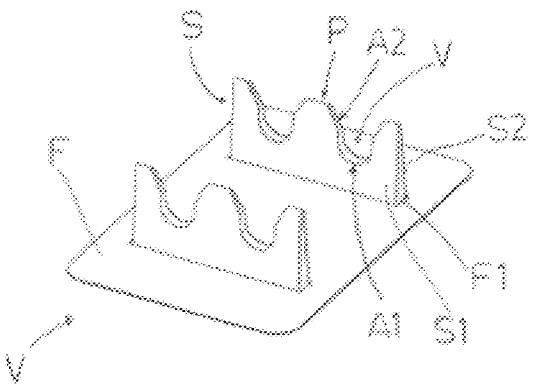
FIG. 1A, already mentioned in the foregoing, illustrates, in a schematic perspective view, a cardboard tray of the prior-art preformed to receive articles, such as bottles, syringes, vials, in a horizontal configuration.

With reference to the accompanying tables of drawings, reference numeral (100) denotes the cardboard tray of the present invention.

The cardboard tray (100) is destined to receive articles, for example having an elongate shape, having a prevalent longitudinal extension, such as bottles, syringes, vials, in a horizontal configuration, then to be inserted in a relative box.

Figure 2A:
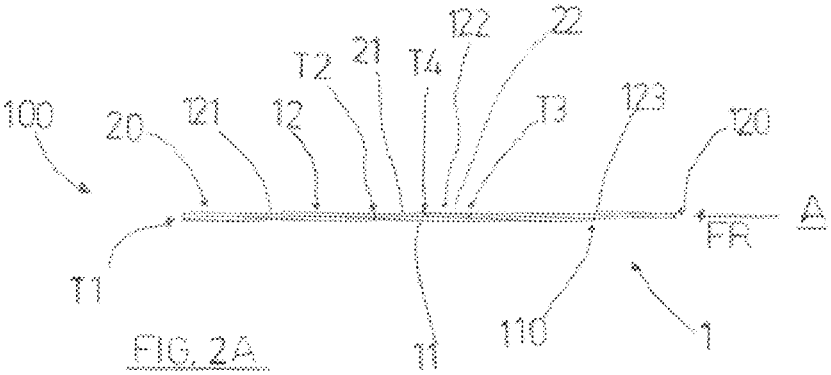
FIG. 2A is a schematic lateral view of the cardboard tray of the invention in a flat initial configuration, and in a first possible preferred embodiment.
Figure 3A:
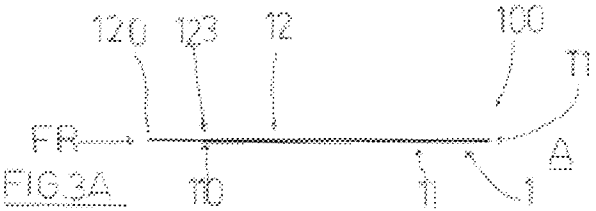
FIG. 3A illustrates, in a schematic lateral view, the cardboard tray of the invention in a flat initial configuration, and in a second possible preferred embodiment.
Figure 3D:
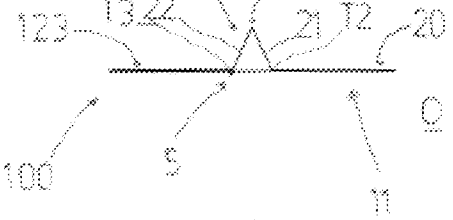
FIG. 3D is a schematic lateral view of the cardboard tray of FIG. 3A in a final opened-out configuration.
Figure 3E:
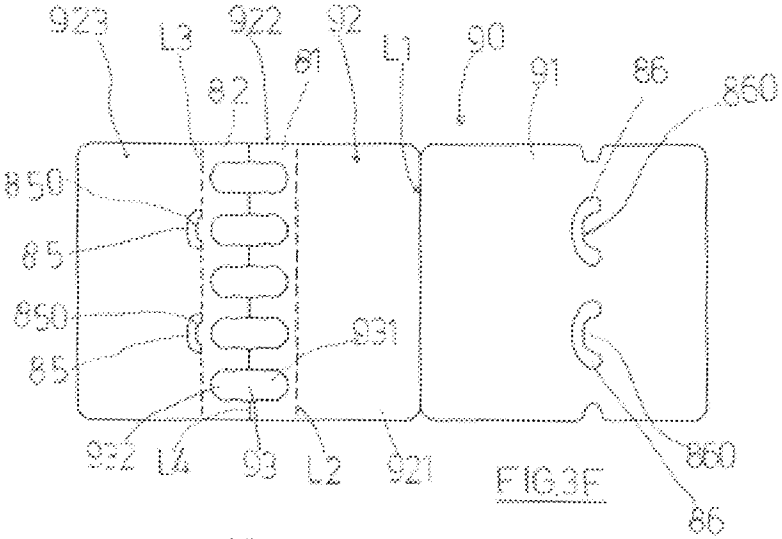
FIG. 3E is a schematic perspective view of the cardboard tray of FIG. 3D in the final opened-out configuration.
Figure 3B:
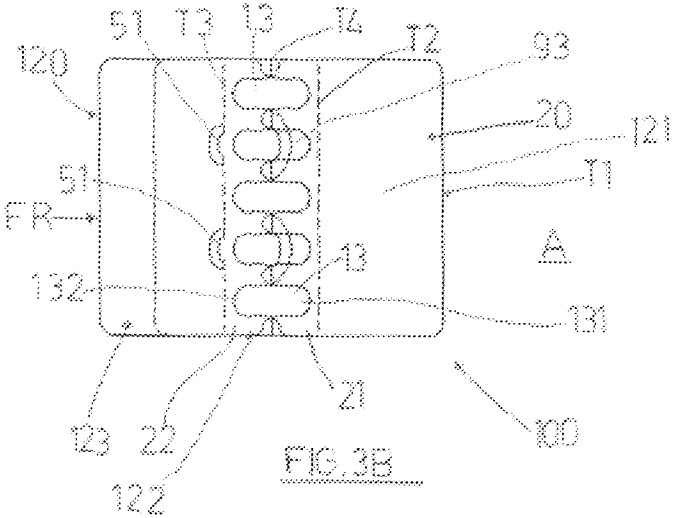
FIG. 3B is a plan view from above of the cardboard tray of FIG. 3A.
Figure 3C:
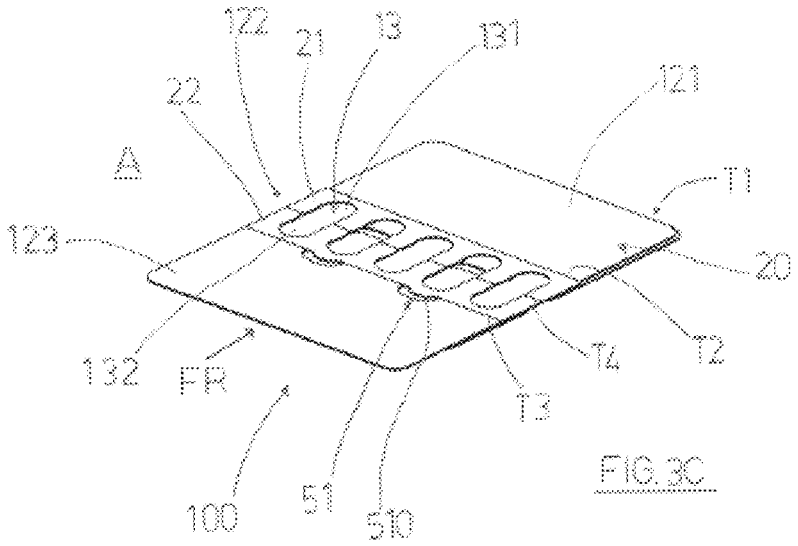
FIG. 3C is a schematic perspective view of the cardboard tray of FIG. 3A.
Figure 3E:
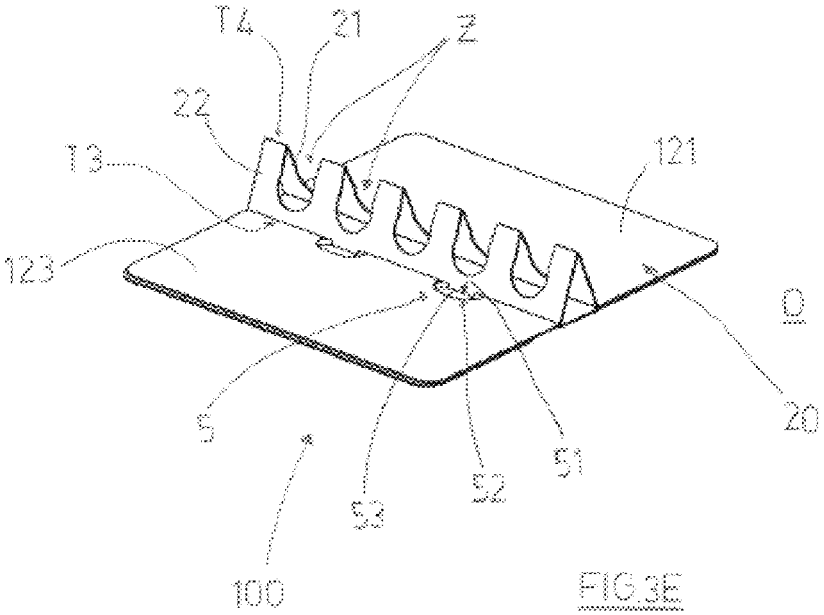
Figure 4C:
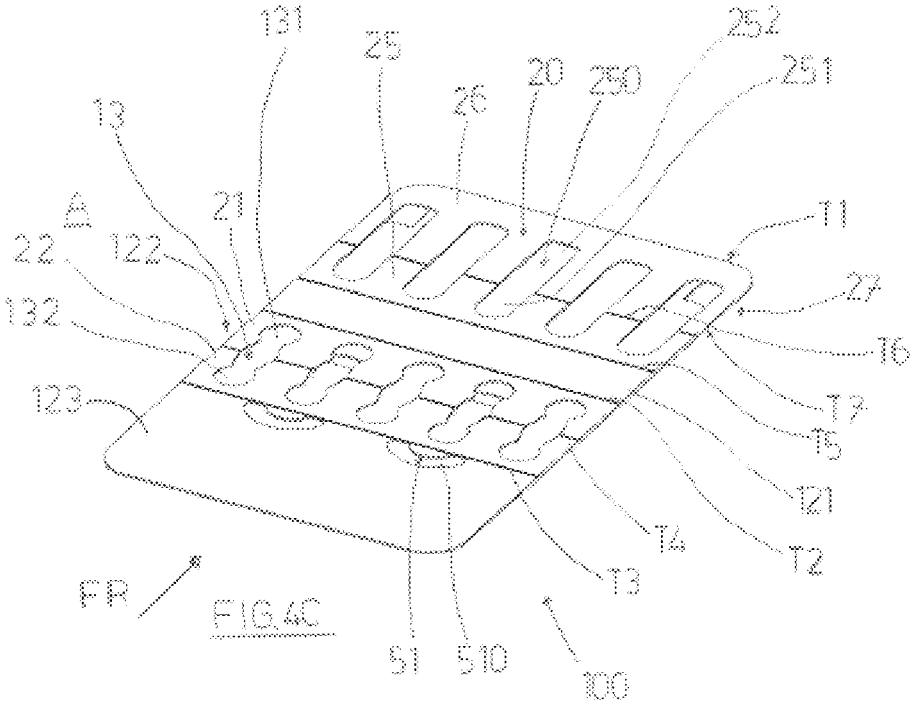
FIG. 4C is a schematic perspective view of the cardboard tray of FIG. 4A.
Figure 5A:
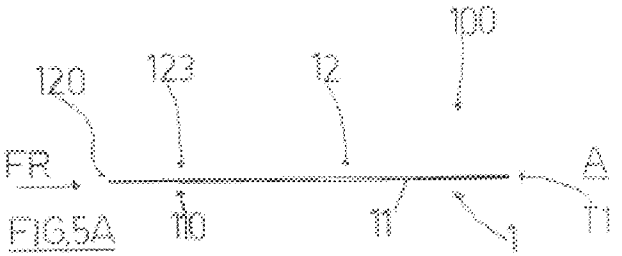
FIG. 5A is a schematic lateral view of the cardboard tray of the invention in a flat initial configuration, and in a fourth possible preferred embodiment.
Figure 5D:
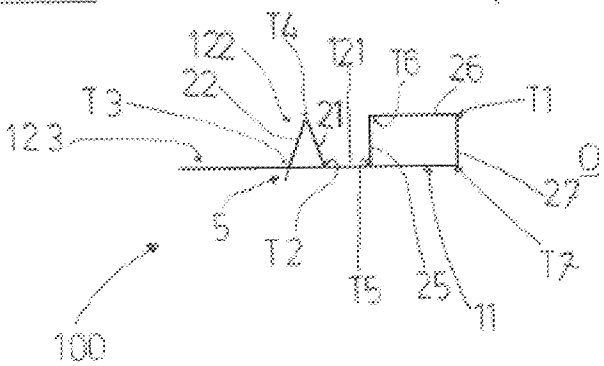
FIG. 5D is again a schematic lateral view of the cardboard tray of FIG. 5A in a final opened-out configuration.
Figure 5C:
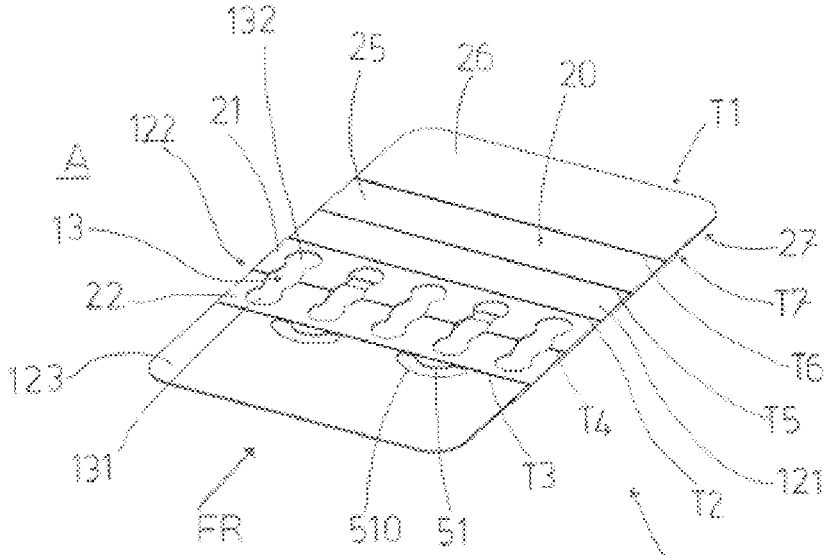
Figures 6A, 6B, 6C, 6F:
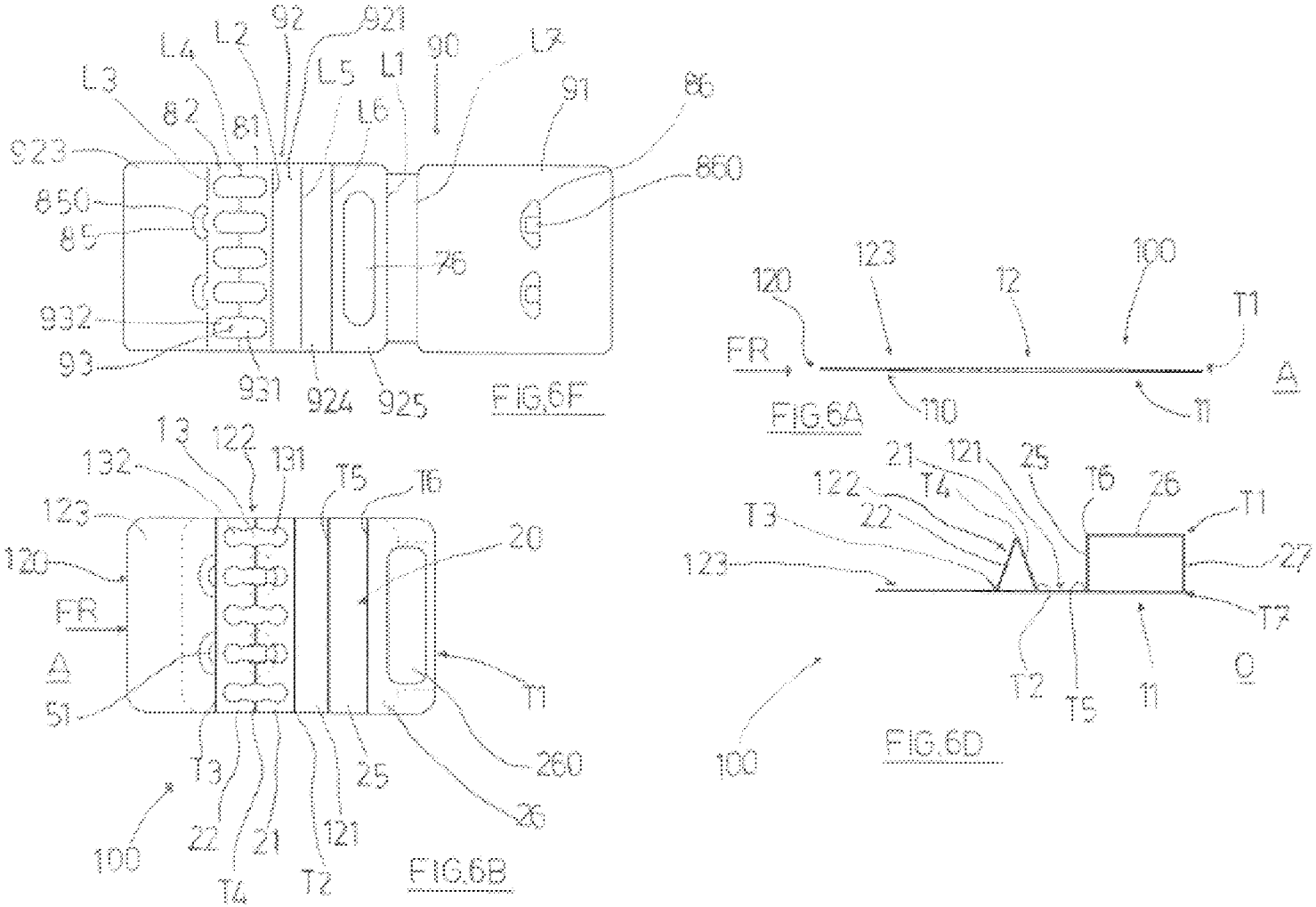
FIG. 6A is a schematic lateral view of the cardboard tray of the invention in a flat initial configuration, and in a fifth possible preferred embodiment.
FIG. 6B is a plan view from above of the cardboard tray of FIG. 6A.
FIG. 6C is a schematic perspective view of the cardboard tray of FIG. 6A.
FIG. 6F is a plan view from above of the cardboard tray of the cardboard die-cut blank from which it is possible to obtain the cardboard tray of figures from 6A to 6E.
Figure 6C:
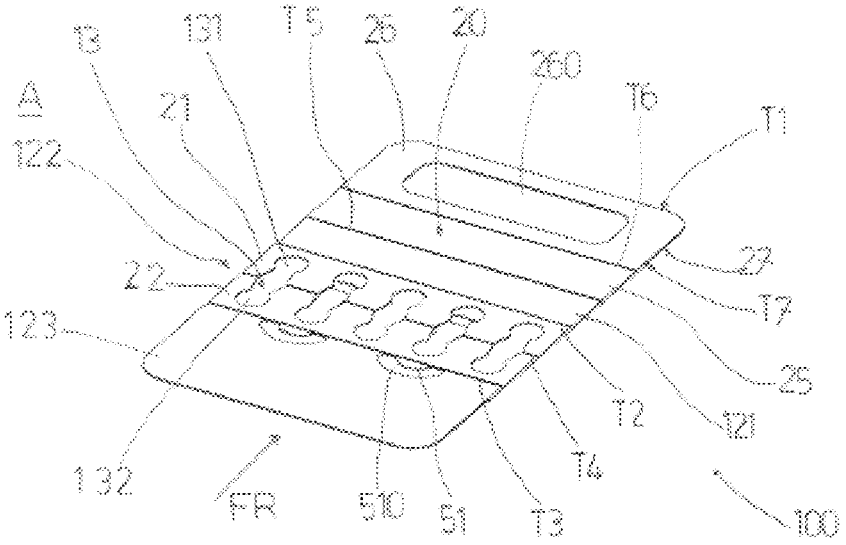

The cardboard tray (100) of the invention, in the various preferred but not exclusive embodiments illustrated, is realised with a single cardboard sheet (1) comprising a first transversal fold line (T1), dividing the cardboard sheet (1) into a first part of sheet (11) and into a second part of sheet (12), with the second part of sheet (12) being folded with respect to the first transversal fold line (T1) in such a way as to be arranged above the first part of sheet (11) to define a first non-operating configuration having a flat shape (A) for the cardboard tray (100) (see for example FIG. 2A, or FIGS. 3A, 3B, 3C, 4A, 4B, 4C, 5A, 5B, 5C, 6A, 6B, 6C).

The cardboard tray (100) is configured in such a way that the second part of sheet (12) arranged above the first part of sheet (11) comprises:

- a second transversal fold line (T2) and a third transversal fold line (T3), parallel to one another and parallel to the first transversal fold line (T1) which are realised in positions such as to define, in the second part of sheet (12), a first portion (20), comprised between the first transversal fold line (T1) and the second transversal fold line (T2), a second portion (122), comprised between the second transversal fold line (T2) and the third transversal fold line (T3), and the third portion (123), comprised between the third transversal fold line (T3) and a transversal side (120) of the second part of sheet (12);
- a fourth transversal fold line (T4) which is realised in the second part of sheet (12) between, and parallel to, the second transversal fold line (T2) and the third transversal fold line (T3), in a position such as to divide the second portion (122) of the second part of sheet (12) into a first semi-part (21) and into a second semi-part (22);
- at least a through-slot (13) realised in the second portion (122) of the second part of sheet (12), between the second transversal fold line (T2) and the third transversal fold line (T3), in such a way as to have a first part of slot (131) in the first semi-part (21) of the second portion (122) and a second part of slot (132) in the second semi-part (22) of the second portion (122).

Further, the cardboard tray (100) has at least a first sector (121) of the first portion (20) of the second part of sheet (12), arranged above the first part of sheet (11), is fixed to the first part of sheet (11) by fastening means.

Owing to these described special characteristics, present in the second part of sheet (12), the cardboard tray (100) can be easily brought from the first flat non-operating configuration (A) to a second opened-out operating configuration (O) in order to receive, and keep, articles, such as bottles, syringes, vials, in a horizontal configuration.

Figure 4E:
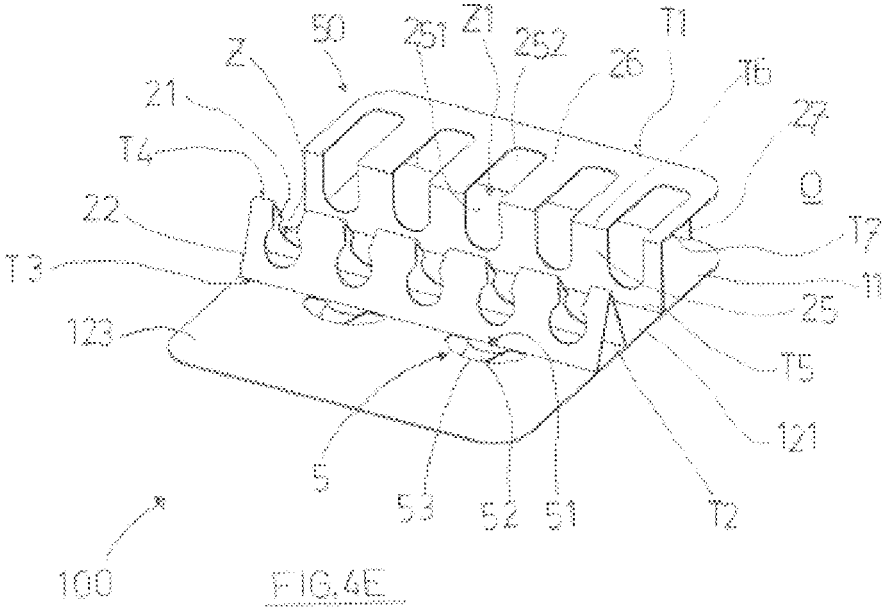
FIG. 4E is again a schematic perspective view of the cardboard tray of FIG. 4D in the final opened-out configuration.
Figure 5E:
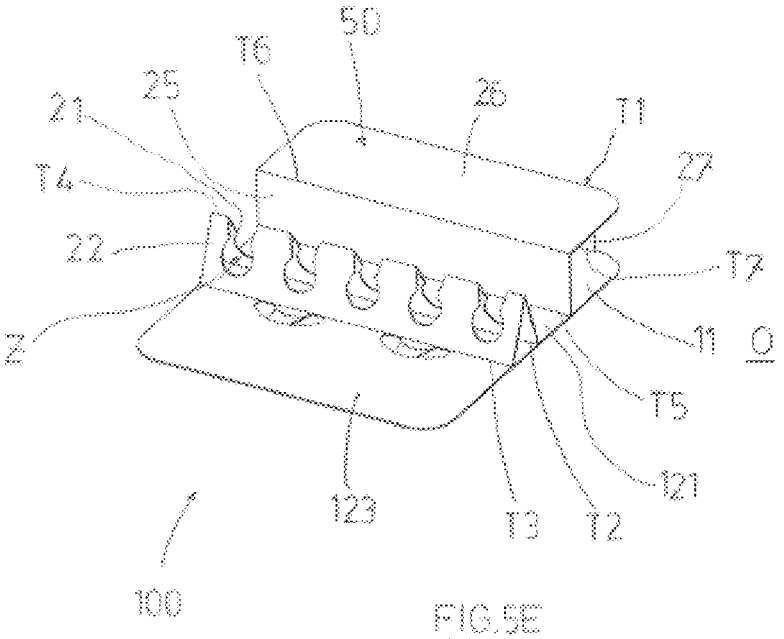
Figure 6E:
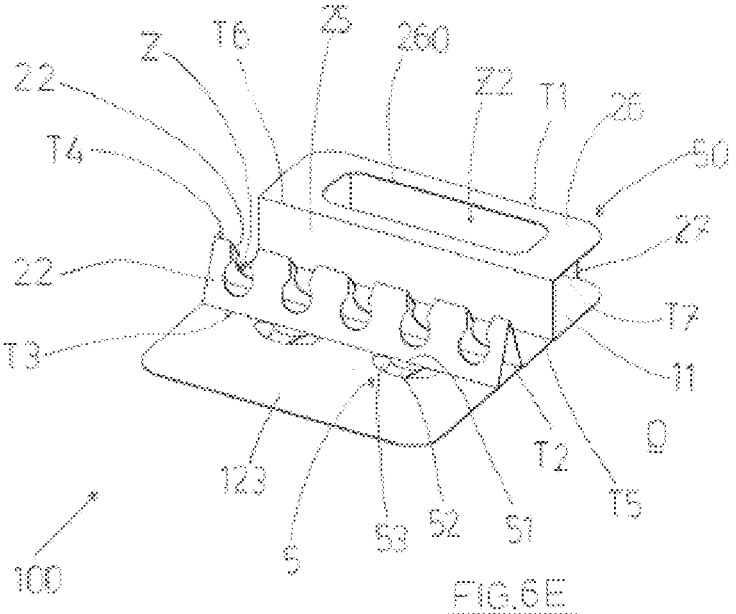
FIG. 6E is a schematic perspective view of the cardboard tray of FIG. 6D in the final opened-out configuration.

In fact, the cardboard tray (100) is configured in such a way that:

- to be able to assume a second opened-out operating configuration (O) (see for example FIGS. 2B, 2C, 3D, 3E, 4D, 4E, 5D, 5E, 6D, 6E) when the third portion (123) of the second part of sheet (12) is pushed see arrows FR in FIGS. 2A, 3A, 3B, 3C, 4A, 4B, 4C, 5A, 5B, 5C, 6A, 6B, 6C) and translated with respect to the first part of sheet (11), towards the at least a first sector (121) of the first portion (20) of the second part of sheet (12) which is fixed to the first part of sheet (11) in such a way as to be able to fold the first semi-part (21) and the second semi-part (22) of the second portion (122) of the second part of sheet (12) with respect to one another, with respect to the fourth transversal fold line (T4), and arrange them projecting superiorly with respect to the first part of sheet (11), with the first part of slot (131) and the second part of slot (132) facing one another to define a seat (Z) for receiving an article in a horizontal configuration.

The cardboard tray (100) of the invention also comprises stabilising means (5) which are conformed and configured for maintaining the first semi-part (21) and the second semi-part (22) of the second portion (122) of the second part of sheet (12) folded with respect to one another and keeping them projecting superiorly to the first part of sheet (11), with the first part of slot (131) and the second part of slot (132) facing one another to define the seat (Z) for receiving an article in a horizontal configuration.

With the special combination of characteristics described herein, the cardboard tray (100) of the invention enables obviating the issues present in the prior-art trays described in the foregoing.

In fact, the cardboard tray (100) of the invention is provided in a first flat non-operating configuration (A), so it does not have any take up space in the vertical direction, except for the thickness of the second part of sheet superposed on the first part of sheet.

Therefore a large number of trays can be stacked on one another, without this requiring an excessive height.

The stores that will be used for the storage of the trays in the flat configuration internally of the packaging machines will, consequently, have a modest volume, even with a large number of trays.

Further, as the trays of the invention are supplied in the first flat non-operating configuration, therefore without any projecting part or portion, the stacking operations, for extraction and movement of the trays are especially easy, and there is no risk of contemporaneously, and accidentally, extracting a number of trays at a time from the store, as instead occurred for the prior-art trays described in the foregoing.

Lastly, the operations required to bring the tray of the invention from the first flat non-operating configuration to the second opened-out operating configuration do not present any particular issues.

In fact, once a tray in the first flat non-operating configuration has been picked up and extracted from a respective store, it will be sufficient to deposit it on a rest surface by the first part of sheet and retain the first part of sheet in gripping means, such as, for example suction cups.

Then, with a simple linear actuator, for example a pusher element activated by an alternating pneumatic cylinder, a pushing action can be exerted on the third portion (123) of the second part of sheet (12) to near it to the at least a first sector (121) of the first portion (20) of the second part of sheet (12) which is fixed to the underlying first part of sheet (11) in such a way as to be able to fold the first semi-part (21) and the second semi-part (22) of the second portion (122) of the second part of sheet (12) with respect to one another, with respect to the fourth transversal fold line (T4), and arrange them projecting superiorly with respect to the first part of sheet (11), with the first part of slot (131) and the second part of slot (132) facing one another to define a seat (Z) for receiving an article in a horizontal configuration.

The presence of the stabilising means (5) also enables keeping this opened-out configuration stable once the pushing action has finished, when the pusher element is retracted.

Other and further advantageous characteristics of the apparatus of the cardboard tray of the invention are described in the following.

According to the preferred embodiments illustrated, the stabilising means (5) comprise at least a first tab (51), which is realised in the third portion (123) of the second part of sheet (12) in proximity of the third transversal fold line (T3), and at least a first through-opening (52) which is realised in the first part of sheet (11).

The at least a first tab (51) and the at least a first through-opening (52) are realised in respective positions in the third portion (123) of the second part of sheet (12) and in the first part of sheet (11) so that, when the third portion (123) of the second part of sheet (12) is pushed, and translated with respect to the first part of sheet (11), towards the at least a first sector (121) of the first portion (20) of the second part of sheet (12) which is fixed to the first part of sheet (11) to bring the cardboard tray (100) from the first flat non-operating configuration (A) into the second opened-out operating configuration (O), the at least a first tab (51) can insert in the at least a first through-opening (52) for maintaining the first semi-part (21) and the second semi-part (22) of the second portion (122) of the second part (12) of sheet folded with respect to one another and keeping them projecting superiorly to the first part of sheet (11), with the first part of slot (131) and the second part of slot (132) facing one another to define the seat (Z) for receiving an article in a horizontal configuration.

In a further advantageous aspect, the stabilising means (5) comprise at least a second tab (53), projecting from an edge of the at least a first though-opening (52), dimensioned and configured in such a way that, when the first tab (51) inserts in the first though-opening (52), the second tab (53) meets the first tab (51) to keep the at least a first tab (51) inserted in the at least a first through-opening (52).

This enables providing greater stability to the opened-out operating configuration of the tray.

The at least a first tab (51) is preferably made at the respective at least a cut (510) present in the third portion (123) of the second part of sheet (12).

In a further preferred aspect, the second part of sheet (12) has a greater length than the first part of sheet (11) so that, with the cardboard tray (100) in the first non-operating configuration having a flat shape (A), the third portion (123) of the second part of sheet (12) remains projecting beyond a transversal side (110) of the first part of sheet (11) opposite the first transversal fold line (T1).

This enables more easily using a pusher element for abutting the projecting edge of the third portion (123).

In particular, the second part of sheet (12) is dimensioned in such a way as to have a greater length than the first part of sheet (11), so that, when the third portion (123) of the second part of sheet (12) is pushed, and translated with respect to the first part of sheet (11), towards the at least a first sector (121) of the first portion (20) of the second part of sheet (12) which is fixed to the first part of sheet (11) in order to bring the cardboard tray (100) from the first flat non-operating configuration (A) into the second opened-out operating configuration (O), the transversal edge (120) of the second part of sheet (12), opposite the first transversal fold line (T1), is arranged substantially at the transversal edge (110) of the first part of sheet (11) opposite the first transversal fold line (T1).

In other possible embodiments, not illustrated, the second part of sheet (12) can also have different dimensions, for example a length that is identical to or smaller than the first part of sheet (11) in such a way that, with the cardboard tray (100) in the first non-operating configuration having a flat shape (A), the transversal edge (120) of the third portion (123) of the second part of sheet (12) coincides with the transversal side (110) of the first part of sheet (11) or is arranged in a position above the first part of sheet (11) which is retracted with respect to the transversal side (110).

In any case, the dimensions of the cardboard sheet, and thus of the first part of sheet and the second part of sheet, as well as the position of the transversal fold lines, can be chosen on the basis of the type and number of articles which are to be received and supported by the tray, and then inserted in a respective box, or also on the basis of the dimensions and shape of the box itself.

In particular, the first part of sheet (11) and the second part of sheet (12) of the cardboard sheet (1) are dimensioned in such a way that the third portion (123) of the second part of sheet (12) comprises a plurality of through-slots (13) so as to define, when the cardboard tray (100) is brought into the second opened-out operating configuration (O), a plurality of seats (Z) for receiving a respective plurality of articles in a horizontal configuration.

For example, in the preferred embodiment of figures from 2A to 2D, one through-slot (13) only is present, and therefore, in the tray brought into the opened-out configuration there will be one only seat for receiving a single corresponding article, while in the preferred embodiments of FIGS. 3A-3E, 4A-4E, 5A-5E, 6A, 6E there are 5 through-slots, and therefore, in the tray brought into the opened-out configuration there will be 5 seats for receiving a respective 5 articles.

The through-slots are made in such a way that when the tray is brought into the opened-out configuration, the through-slots define a seat having a shape suitable to receive and retain a portion of the lateral surface of a respective article, such as a bottle, a syringe, a vial, or other articles having a similar shape.

The at least a first sector (121) of the first portion (20) of the second part of sheet (12) is preferably fixed to the first part of sheet (11) by gluing. Other modalities may also be used for fixing one to the other.

In the embodiment illustrated in figures from 2A to 2E, for example a sector or all of the first portion (20) of the second part of sheet (12) can be fixed, for example, by gluing, to the underlying first part of sheet (11).

FIGS. 4A-4E, 5A-5E, 6A-6E illustrate further preferred and particular embodiments of the cardboard tray (100) of the present invention.

The cardboard tray (100) is configured in such a way that the first portion (20) of the second part of sheet (12) comprises a fifth transversal fold line (T5) and a sixth transversal fold line (T6), parallel to one another and parallel to the first transversal fold line (T1) and to the second transversal fold line (T2), which are realised in positions such as to divide the first portion (20) of the second part of sheet (12) into a first sector (121), between the second transversal fold line (T2) and the fifth transversal fold line (T5), which is fixed to the first part of sheet (11) by fastening means (for example gluing), a second sector (25), between the fifth transversal fold line (T5) and the sixth transversal fold line (T6) and a third sector (26), between the sixth transversal fold line (T6) and the first transversal fold line (T1) (see for example FIGS. 4B, 4C, 5B, 5C, 6B, 6C).

Further, in these cases, the cardboard tray (100) is configured in such a way that the first part of sheet (11) comprises a seventh transversal fold line (T7) parallel to the first transversal fold line (T1) and realised at a distance from the first transversal fold line (T1) so as to define, in the first part of sheet (11), a fourth sector (27).

In this way, owing to these further special characteristics present in the embodiments illustrated in these figures, when the cardboard tray (100) is brought into the second opened-out operating configuration (O), the fourth sector (27) present in the first part of sheet (11) can be folded with respect to the seventh fold line (T7) (for example by means of a pusher or another element that rotates it with respect to the seventh fold line (T7)) and arranged at an angle and projecting superiorly to the first part of sheet (11) in such a way as to enable folding, and arranging at an angle to one another, the second sector (25) and the third sector (26), with the second sector (25) projecting superiorly of the first part of sheet (11) and at an angle with respect to the first sector (121) fixed to the first part of sheet (11), so as to form an auxiliary opened-out body (50) (see for example FIGS. 4D, 4E, 5D, 5E, 6D, 6E).

Owing to the possibility of obtaining an auxiliary opened-out body (50), when the tray is brought into the second opened-out operating configuration (O), it is possible to obtain additional functions.

For example, in the illustrated embodiment of FIGS. 5A-5E, when the auxiliary opened-out body (50) is formed, the second sector (25) of the second part of sheet (12) is at an angle with respect to the first sector (121), for example arranged at 90° with respect to the first sector (121), constituting an abutment wall for an end of an article inserted in a horizontal configuration in the seat (Z), stabilising the position thereof.

Further, the third sector (26), arranged above and parallel to the first part of sheet (11) can constitute a rest surface for a supplementary article, such as, for example a leaflet or information pamphlet containing information relative to the article positioned in the seat (Z).

In the preferred embodiment illustrated in the FIGS. 4A-4E, the cardboard tray (100) is configured in such a way as to comprise at least a supplementary through-slot (250) which is realised transversally with respect to the fifth transversal fold line (T5) and to the sixth transversal fold line (T6) in such a way as to involve, with a first through-slot section (251), a part of the second sector (25), and with a second through-slot section (252), a part of the third sector (26) of the second part of sheet (12).

In this way, when the auxiliary opened-out body (50) is formed the first through-slot section (251) and the second through-slot section (252) of the at least a supplementary through-slot (250) are arranged at an angle with respect to one another so as to define a housing (Z1) (see FIG. 4E) for the positioning of an end part of an article inserted in the seat (Z) in a horizontal configuration.

For example, in a case in which the article to be positioned in the seat (Z) is constituted by a syringe, the housing (Z1) can accommodate internally thereof a part of the needle of the syringe.

In the preferred embodiment of FIGS. 6A-6E, on the other hand, the cardboard tray (100) can be made in such a way as to comprise at least a supplementary through-slot (260) which is realised in the third sector (26) of the second part of sheet (12), between the sixth transversal fold line (T6) and the first transversal fold line (T1).

In this way, when the auxiliary opened-out body (50) is formed, the supplementary through-slot (260) forms a housing (Z2) (see FIG. 6E) for the positioning of an end part of a second article.

For example, a different article from the one positioned in the seat (Z) can be inserted in the housing (Z2).

In a case in which the article positioned in the seat (Z) is a syringe, a vial or small bottle containing a pharmaceutical product to be administered using the syringe can be positioned in the housing (Z2).

The auxiliary opened-out body (50), once formed, can be for example kept opened-out by the abutments present in the transport means of the packaging machine, during the transport of the opened-out cardboard tray up until the insertion thereof in a relative box.

Figure 2E:
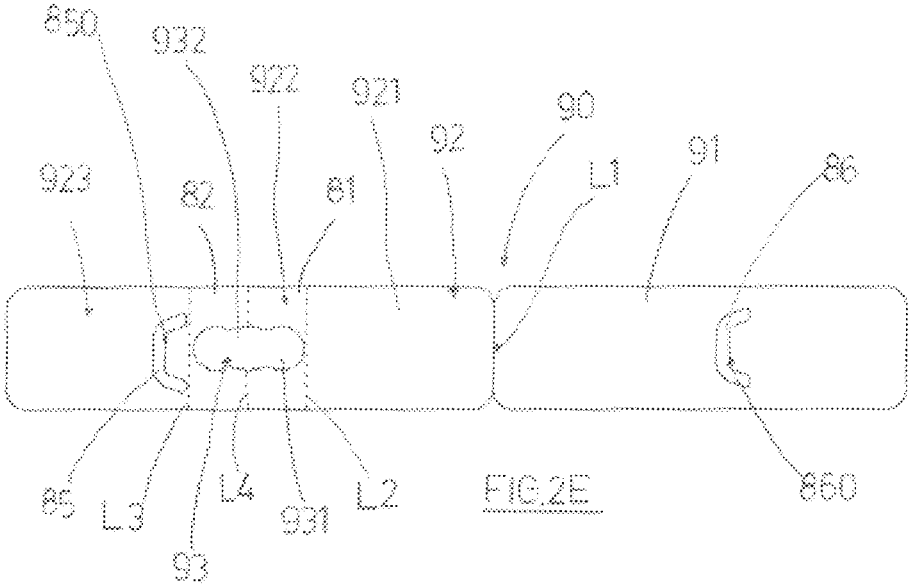
FIG. 2E is a plan view from above of the cardboard tray of the cardboard die-cut blank from which it is possible to obtain the cardboard tray of figures from 2A to 2D.
Figure 2B:
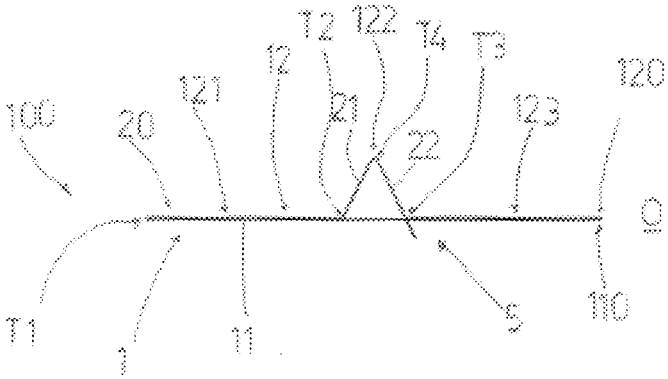
FIG. 2B is again a schematic lateral view of the cardboard tray of FIG. 2A in a final opened-out configuration.
Figure 2D:
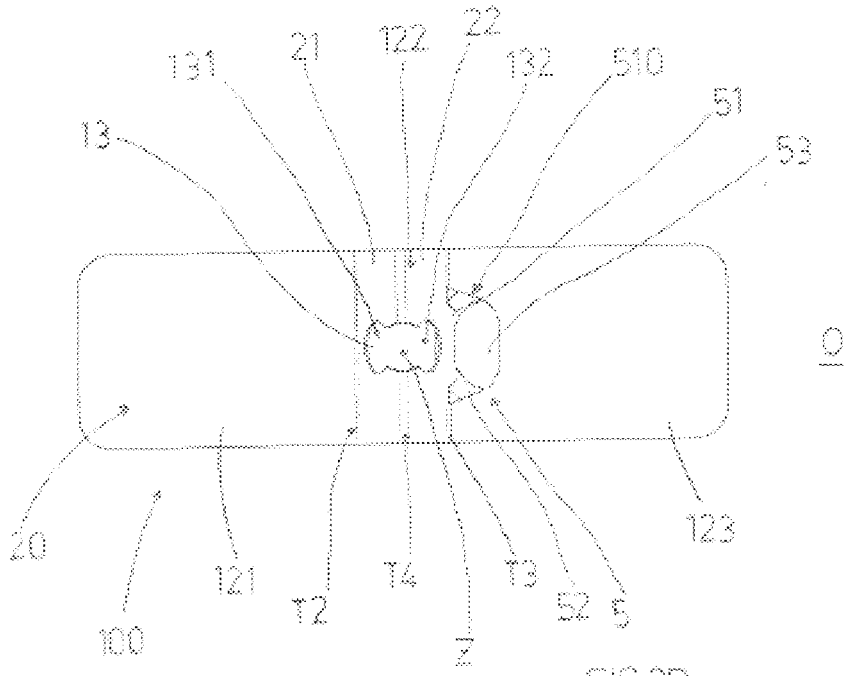
FIG. 2D is a plan view from above of FIG. 2B.
Figure 2C:
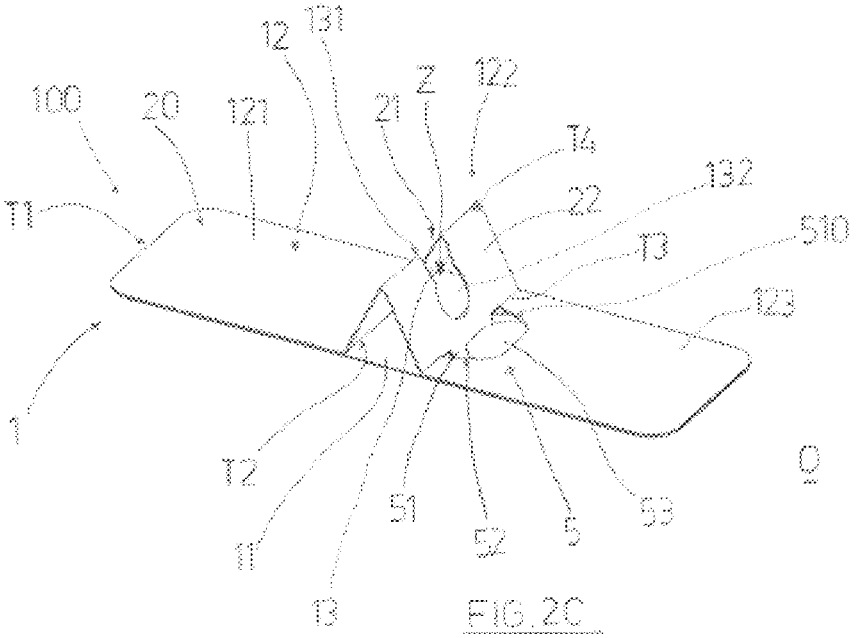
FIG. 2C is again a schematic perspective view of the cardboard tray of FIG. 2A in the final opened-out configuration of FIG. 2B.
Figure 5F:
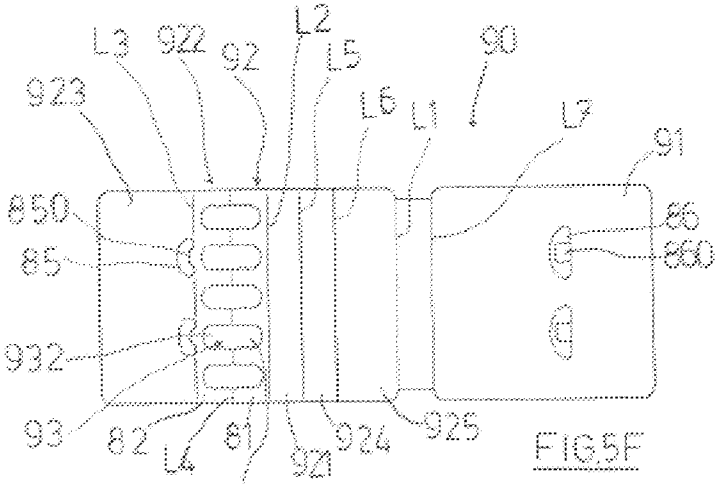
FIG. 5F is a plan view from above of the cardboard tray of the cardboard die-cut blank from which it is possible to obtain the cardboard tray of figures from 5A to 5E.
Figure 5G:
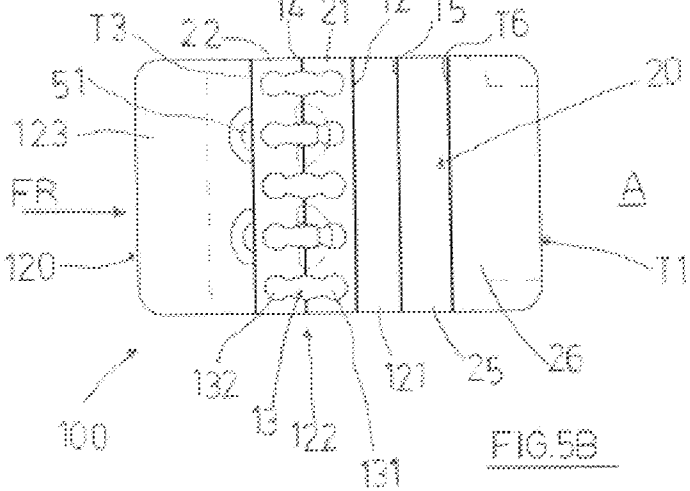
FIG. 5B is a plan view from above of the cardboard tray of FIG. 5A.
FIG. 5C is a schematic perspective view of the cardboard tray of FIG. 5A.
FIG. 5E is a schematic perspective view of the cardboard tray of FIG. 5D in the final opened-out configuration.

FIGS. 2E, 3F, 4F, 5F, 6F illustrate preferred cardboard die-cut blanks from which the cardboard trays of the invention can be obtained, illustrated respectively in figures from 2A to 2D, from 3A to 3E, from 4A to 4E, from 5A to 5E, from 6A to 6E.

Each of the die-cut cardboard blanks (90) comprises:

a first transversal score line (L1) which divides the die-cut blank (90) into a first portion of die-cut blank (91) and into a second portion of die-cut blank (92) in such a way that the second portion of die-cut blank (92) can be folded about the first transversal score line (L1) and with respect to the first portion of die-cut blank (91) in order to be arranged above the first portion of die-cut blank (91) and fixed thereto, for example by gluing and to obtain the tray in the first flat non-operating configuration.

The die-cut blank (90) also comprises:

a second transversal score line (L2) and a third transversal score line (L3) in the second portion of die-cut blank (92), which are parallel to one another and parallel to the first transversal score line (L1), which are realised in positions such as to define, in the second portion of the die-cut blank (92), a first sector (921), comprised between the first transversal score line (L1) and the second transversal score line (L2), a second sector (922), comprised between the second transversal score line (L2) and the third transversal score line (L3), and a third sector (923), comprised between the third transversal score line (T3) and a transversal side (920) of the second portion of die-cut blank (92);

a fourth transversal score line (L4) which is realised in the second sector (922) between, and parallel to, the second transversal score line (L2) and to the third transversal score line (L3), in a position such as to divide the second sector (922) into a first semi-part (81) and into a second semi-part (82);

at least a through-window (93) realised in the second sector (922) of the second portion of die-cut blank (92), between the second transversal score line (L2) and the third transversal score line (L3), in such a way as to have a first part of through-window (931) in the first semi-part (81) of the second sector (922) and a second part of through-window (932) in the second semi-part (82) of the second sector (922);

at least a first cut (85) realised in the third sector (923) of the second portion of die-cut blank (92), in proximity of the third transversal score line (L3) and conformed in such a way that an edge (850) of the first cut (85) has a tab shape; at least a second cut (86) realised in the first portion of die-cut blank (91) having a shape such as to be able to allow insertion of the edge having a tab shape of the first arched cut (85).

The at least a second cut (86) is preferably conformed in such a way that a respective edge (860) has a tab shape.

The die-cut blank (90) can be dimensioned in such a way as to comprise a plurality of through-windows (93) realised in the second sector (922) of the second portion of die-cut blank (92).

For the cardboard trays of the preferred embodiments of FIGS. 4A-4E, 5A-5E, 6A-6E, the die-cut cardboard blank (90) can be made in such a way as to comprise (see FIGS. 4F, 5F, 6F) further, a fifth transversal score line (L5) and a sixth transversal score line (L6), realised in the second portion of die-cut blank (92) between the first transversal score line (L1) and the second transversal score line (L2), parallel to one another and in positions such as to define, in the second portion of die-cut blank (92), a fourth sector (924), comprised between the fifth transversal score line (L5) and the sixth transversal score line (L6), and a fifth sector (925), comprised between the sixth transversal score line (L6) and the first transversal score line (L1), and comprising a seventh transversal score line (L7) realised in the first portion of die-cut blank (91) and parallel to the first transversal score line (L1).

In the cardboard tray of the preferred embodiment of FIGS. 4A-4E, the die-cut cardboard blank (90) (see FIG. 4F) is realised in such a way as to comprise at least a supplementary through-window (75) made transversally to the fifth score line (L5) and to the sixth score line (L6) in such a way as to involve, with a first window section (751), a part of the fourth sector (924) and, with a second window section (752), a part of the fifth sector (925).

In relation to the cardboard tray of the preferred embodiment of FIGS. 6A-6E, the die-cut cardboard blank (90) (see FIG. 6F) is made in such a way as to comprise at least a supplementary through-window (76) realised in the fifth sector (925) of the second portion of die-cut blank (92), between the sixth transversal score line (L6) and the first transversal score line (L1).

The invention claimed is:

1. A cardboard tray for receiving articles, such as bottles, syringes, vials, in a horizontal configuration, realised with a single cardboard sheet comprising a first transversal fold line, dividing the cardboard sheet into a first part of sheet and into a second part of sheet, with the second part of sheet being folded with respect to the first transversal fold line in such a way as to be arranged above the first part of sheet to define a first non-operating configuration having a flat shape for the cardboard tray;

wherein the second part of sheet arranged above the first part of sheet comprises:

a second transversal fold line and a third transversal fold line, parallel to one another and parallel to the first transversal fold line which are realised in positions such as to define, in the second part of sheet, a first portion, comprised between the first transversal fold line and the second transversal fold line, a second portion, comprised between the second transversal fold line and the third transversal fold line, and a third portion, comprised between the third transversal fold line and a transversal side of the second part of sheet;

a fourth transversal fold line which is realised in the second part of sheet between, and parallel to, the second transversal fold line and the third transversal fold line, in a position such as to divide the second portion of the second part of sheet into a first semi-part and into a second semi-part;

at least a through-slot realised in the second portion of the second part of sheet, between the second transversal fold line and the third transversal fold line, in such a way as to have a first part of slot in the first semi-part of the second portion and a second part of slot in the second semi-part of the second portion;

wherein at least a first sector of the first portion of the second part of sheet is fixed to the first part of sheet by fastening means, wherein the cardboard tray is configured in such a way as:

to be able to assume a second opened-out operating configuration when the third portion of the second part of sheet is pushed, and translated with respect to the first part of sheet, towards the at least a first sector of the first portion of the second part of sheet which is fixed to the first part of sheet in such a way as to be able to fold the first semi-part and the second semi-part of the second portion of the second part of sheet with respect to one another, with respect to the fourth transversal fold line, and arrange them projecting superiorly with respect to the first part of sheet, with the first part of slot and the second part of slot facing one another to define a seat for receiving an article in a horizontal configuration;

and in such a way as to comprise stabilising means for maintaining the first semi-part and the second semi-part of the second portion of the second part of sheet folded with respect to one another and keeping them projecting superiorly to the first part of sheet, with the first part of slot and the second part of slot facing one another to define the seat for receiving an article in a horizontal configuration; and wherein the cardboard tray is configured in such a way that the first portion of the second part of sheet comprises a fifth transversal fold line and a sixth transversal fold line, parallel to one another and parallel to the first transversal fold line and to the second transversal fold line, which are realised in positions such as to divide the first portion of the second part of sheet into a first sector, between the second transversal fold line and the fifth transversal fold line, which is fixed to the first part of sheet by fastening means, a second sector, between the fifth transversal fold line and the sixth transversal fold line and a third sector, between the sixth transversal fold line and the first transversal fold line, and so that the first part of sheet comprises a seventh transversal fold line parallel to the first transversal fold line and at a distance from the first transversal fold line to define, in the first part of sheet, a fourth sector which, when the cardboard tray is brought into the second opened-out operating configuration, can be folded with respect to the seventh fold line and arranged at an angle and projecting superiorly to the first part of sheet in such a way as to enable folding, and arranging at an angle to one another, the second sector and the third sector, with the second sector projecting superiorly to the first part of sheet and at an angle with respect to the first sector fixed to the first part of sheet, so as to form an auxiliary opened-out body.

2. The cardboard tray as claimed in claim 1, wherein the stabilising means comprise at least a first tab realised in the third portion of the second part of sheet in proximity of the third transversal fold line and at least a first through-opening realised in the first part of sheet, the at least a first tab and the at least a first through-opening are realised in respective positions in the third portion of the second part of sheet and in the first part of sheet so that, when the third portion of the second part of sheet is pushed, and translated with respect to the first part of sheet, towards the at least a first sector of the first portion of the second part of sheet which is fixed to the first part of sheet to bring the cardboard tray from the first flat non-operating configuration into the second opened-out operating configuration, the at least a first tab can insert in the at least a first through-opening for maintaining the first semi-part and the second semi-part of the second portion of the second part of sheet folded with respect to one another and keeping them projecting superiorly to the first part of sheet, with the first part of slot and the second part of slot facing one another to define the seat for receiving an article in a horizontal configuration.

3. The cardboard tray as claimed in claim 2, wherein the stabilising means comprise at least a second tab, projecting from an edge of the at least a first though-opening, dimensioned and configured in such a way that, when the first tab inserts in the first though-opening, the second tab meets the first tab to keep the at least a first tab inserted in the at least a first through-opening.

4. The cardboard tray as claimed in claim 2, wherein the at least a first tab is made at a respective at least a cut present in the third portion of the second part of sheet.

5. The cardboard tray as claimed in claim 1, wherein the second part of sheet has a greater length than the first part of sheet so that, with the cardboard tray in the first non-operating configuration having a flat shape, the third portion of the second part of sheet remains projecting beyond a transversal side of the first part of sheet opposite the first transversal fold line.

6. The cardboard tray as claimed in claim 5, wherein the second part of sheet is dimensioned in such a way as to have a greater length than the first part of sheet, so that, when the third portion of the second part of sheet is pushed, and translated with respect to the first part of sheet, towards the at least a first sector of the first portion of the second part of sheet which is fixed to the first part of sheet in order to bring the cardboard tray from the first flat non-operating configuration into the second opened-out operating configuration, the transversal edge of the second part of sheet, opposite the first transversal fold line, is arranged substantially at the transversal edge of the first part of sheet opposite the first transversal fold line.

7. The cardboard tray as claimed in claim 1, wherein the first part of sheet and the second part of sheet of the cardboard sheet are dimensioned in such a way that the third portion of the second part of sheet comprises a plurality of through-slots so as to define, when the cardboard tray is brought into the second opened-out operating configuration, a plurality of seats for receiving a respective plurality of articles in a horizontal configuration.

8. The cardboard tray as claimed in claim 1, comprising at least a supplementary through-slot realised transversally with respect to the fifth transversal fold line and to the sixth transversal fold line in such a way as to involve, with a first through-slot section, a part of the second sector, and with a second through-slot section, a part of the third sector of the second part of sheet, in such a way that when the auxiliary opened-out body is formed the first through-slot section and the second through-slot section of the at least a supplementary through-slot are arranged at an angle with respect to one another so as to define a housing for the positioning of an end part of an article inserted in the seat in a horizontal configuration.

9. The cardboard tray as claimed in claim 1, comprising at least a supplementary through-slot realised in the third sector of the second part of sheet, between the sixth transversal fold line and the first transversal fold line, in such a way that when the auxiliary opened-out body is formed the supplementary through-slot forms a housing for positioning a second article.

10. A cardboard tray for receiving articles, such as bottles, syringes, vials, in a horizontal configuration, realised with a single cardboard sheet comprising a first transversal fold line, dividing the cardboard sheet into a first part of sheet and into a second part of sheet, with the second part of sheet being folded with respect to the first transversal fold line in such a way as to be arranged above the first part of sheet to define a first non-operating configuration having a flat shape for the cardboard tray;

wherein the second part of sheet arranged above the first part of sheet comprises:

a second transversal fold line and a third transversal fold line, parallel to one another and parallel to the first transversal fold line which are realised in positions such as to define, in the second part of sheet, a first portion, comprised between the first transversal fold line and the second transversal fold line, a second portion, comprised between the second transversal fold line and the third transversal fold line, and a third portion, comprised between the third transversal fold line and a transversal side of the second part of sheet;

a fourth transversal fold line which is realised in the second part of sheet between, and parallel to, the second transversal fold line and the third transversal fold line, in a position such as to divide the second portion of the second part of sheet into a first semi-part and into a second semi-part;

at least a through-slot realised in the second portion of the second part of sheet, between the second transversal fold line and the third transversal fold line, in such a way as to have a first part of slot in the first semi-part of the second portion and a second part of slot in the second semi-part of the second portion;

wherein at least a first sector of the first portion of the second part of sheet is fixed to the first part of sheet by fastening means, wherein the cardboard tray is configured in such a way as:

to be able to assume a second opened-out operating configuration when the third portion of the second part of sheet is pushed, and translated with respect to the first part of sheet, towards the at least a first sector of the first portion of the second part of sheet which is fixed to the first part of sheet in such a way as to be able to fold the first semi-part and the second semi-part of the second portion of the second part of sheet with respect to one another, with respect to the fourth transversal fold line, and arrange them projecting superiorly with respect to the first part of sheet, with the first part of slot and the second part of slot facing one another to define a seat for receiving an article in a horizontal configuration;

and in such a way as to comprise stabilising means for maintaining the first semi-part and the second semi-part of the second portion of the second part of sheet folded with respect to one another and keeping them projecting superiorly to the first part of sheet, with the first part of slot and the second part of slot facing one another to define the seat for receiving an article in a horizontal configuration; and wherein the at least a first sector of the first portion of the second part of sheet is fixed to the first part of sheet by gluing.

11. A die-cut cardboard blank for realising a cardboard tray for receiving articles, such as bottles, syringes, vials, in a horizontal configuration, realised with a single cardboard sheet comprising a first transversal fold line, dividing the cardboard sheet into a first part of sheet and into a second part of sheet, with the second part of sheet being folded with respect to the first transversal fold line in such a way as to be arranged above the first part of sheet to define a first non-operating configuration having a flat shape for the cardboard tray;

wherein the second part of sheet arranged above the first part of sheet comprises:

a second transversal fold line and a third transversal fold line, parallel to one another and parallel to the first transversal fold line which are realised in positions such as to define, in the second part of sheet, a first portion, comprised between the first transversal fold line and the second transversal fold line, a second portion, comprised between the second transversal fold line and the third transversal fold line, and a third portion, comprised between the third transversal fold line and a transversal side of the second part of sheet;

a fourth transversal fold line which is realised in the second part of sheet between, and parallel to, the second transversal fold line and the third transversal fold line, in a position such as to divide the second portion of the second part of sheet into a first semi-part and into a second semi-part;

at least a through-slot realised in the second portion of the second part of sheet, between the second transversal fold line and the third transversal fold line, in such a way as to have a first part of slot in the first semi-part of the second portion and a second part of slot in the second semi-part of the second portion;

wherein at least a first sector of the first portion of the second part of sheet is fixed to the first part of sheet by fastening means, wherein the cardboard tray is configured in such a way as:

to be able to assume a second opened-out operating configuration when the third portion of the second part of sheet is pushed, and translated with respect to the first part of sheet, towards the at least a first sector of the first portion of the second part of sheet which is fixed to the first part of sheet in such a way as to be able to fold the first semi-part and the second semi-part of the second portion of the second part of sheet with respect to one another, with respect to the fourth transversal fold line, and arrange them projecting superiorly with respect to the first part of sheet, with the first part of slot and the second part of slot facing one another to define a seat for receiving an article in a horizontal configuration;

and in such a way as to comprise stabilising means for maintaining the first semi-part and the second semi-part of the second portion of the second part of sheet folded with respect to one another and keeping them projecting superiorly to the first part of sheet, with the first part of slot and the second part of slot facing one another to define the seat for receiving an article in a horizontal configuration; and the die-cut cardboard blank comprising:

a first transversal score line which divides the die-cut blank into a first portion of die-cut blank and into a second portion of die-cut blank in such a way that the second portion of die-cut blank can be folded about the first transversal score line and with respect to the first portion of die-cut blank in order to be arranged above the first portion of die-cut blank;

a second transversal score line and a third transversal score line in the second portion of die-cut blank, which are parallel to one another and parallel to the first transversal score line, which are realised in positions such as to define, in the second portion of the die-cut blank, a first sector, comprised between the first transversal score line and the second transversal score line, a second sector, comprised between the second transversal score line and the third transversal score line, and a third sector, comprised between the third transversal score line and a transversal side of the second portion of die-cut blank;

a fourth transversal score line which is realised in the second sector between, and parallel to, the second transversal score line and to the third transversal score line, in a position such as to divide the second sector into a first semi-part and into a second semi-part;

at least a through-window realised in the second sector of the second portion of die-cut blank, between the second transversal score line and the third transversal score line, in such a way as to have a first part of through-window in the first semi-part of the second sector and a second part of through-window in the second semi-part of the second sector;

at least a first cut realised in the third sector of the second portion of die-cut blank, in proximity of the third transversal score line and conformed in such a way that an edge of the first cut has a tab shape;

at least a second cut realised in the first portion of die-cut blank having a shape such as to be able to allow insertion of the edge having a tab shape of the first arched cut.

12. The die-cut cardboard blank as claimed in claim 11, wherein the at least a second cut is conformed in such a way that a respective edge has a tab shape.

13. The die-cut cardboard blank as claimed in claim 11, dimensioned in such a way as to comprise a plurality of through-windows realised in the second sector of the second portion of die-cut blank.

14. The die-cut cardboard blank as claimed in claim 11, further comprising a fifth transversal score line and a sixth transversal score line, realised in the second portion of die-cut blank between the first transversal score line and the second transversal score line, parallel to one another and in positions such as to define, in the second portion of die-cut blank, a fourth sector, comprised between the fifth transversal score line and the sixth transversal score line, and a fifth sector, comprised between the sixth transversal score line and the first transversal score line, and comprising a seventh transversal score line realised in the first portion of die-cut blank and parallel to the first transversal score line.

15. The die-cut cardboard blank as claimed in claim 14, comprising at least a supplementary through-window realised transversally to the fifth score line and the sixth score line in such a way as to involve, with a first window section, a part of the fourth sector and, with a second window section, a part of the fifth sector.

16. The die-cut cardboard blank as claimed in claim 14, comprising at least a supplementary through-window realised in the fifth sector of the second portion of die-cut blank, between the sixth transversal score line and the first transversal score line.

* * * * *